US009490589B2

(12) United States Patent
Shiratori et al.

(10) Patent No.: US 9,490,589 B2
(45) Date of Patent: Nov. 8, 2016

(54) DIFFERENTIAL SIGNAL CONNECTOR CAPABLE OF REDUCING SKEW BETWEEN A DIFFERENTIAL SIGNAL PAIR

(71) Applicant: Japan Aviation Electronics Industry, Limited, Tokyo (JP)

(72) Inventors: Masayuki Shiratori, Tokyo (JP); Shuichi Aihara, Tokyo (JP); Masayuki Katayanagi, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 28 days.

(21) Appl. No.: 14/474,949

(22) Filed: Sep. 2, 2014

(65) Prior Publication Data

US 2014/0370728 A1 Dec. 18, 2014

Related U.S. Application Data

(62) Division of application No. 13/357,157, filed on Jan. 24, 2012, now Pat. No. 8,951,050.

(30) Foreign Application Priority Data

| | | |
|---|---|---|
| Feb. 23, 2011 | (JP) | 2011-037321 |
| Oct. 11, 2011 | (JP) | 2011-224075 |
| Oct. 11, 2011 | (JP) | 2011-224098 |
| Oct. 11, 2011 | (JP) | 2011-224139 |

(51) Int. Cl.
*H01R 24/00* (2011.01)
*H01R 13/6597* (2011.01)

(Continued)

(52) U.S. Cl.
CPC ..... *H01R 13/6597* (2013.01); *H01R 12/7082* (2013.01); *H01R 13/04* (2013.01);

(Continued)

(58) Field of Classification Search
CPC ..... H01R 23/7073; H01R 23/6873; H01R 23/688; H01R 13/658; H01R 13/65802
USPC ..... 439/79, 660, 108, 607.4
See application file for complete search history.

(56) References Cited

U.S. PATENT DOCUMENTS 4,221,458 A 9/1980 Hughes et al.
5,387,114 A * 2/1995 Brunker ..... H01R 23/6873 29/842

(Continued)

FOREIGN PATENT DOCUMENTS

CN 1992448 A 7/2007
CN 101106229 A 1/2008

(Continued)

OTHER PUBLICATIONS

Japanese Office Action dated Apr. 22, 2015 in Japanese Application No. 2011-224075 with English translation of the relevant parts.

(Continued)

*Primary Examiner* — Hien Vu
(74) *Attorney, Agent, or Firm* — Collard & Roe, P.C.

(57) ABSTRACT

A differential signal connector includes a plurality of pairs of signal contacts, a plurality of ground contacts, and an insulating housing holding the signal contacts and the ground contacts. On a first connection side for connection to a connection partner, the ground contacts are arranged on both sides of each pair of signal contacts so that a contact array of a fixed pitch is formed. On a second connection side for connection to a board, the ground contacts are arranged spaced apart from each other in a first row, while the pairs of signal contacts, which are adjacently arranged on both sides of the ground contact on the first connection side, are arranged so as to be allocated in a second row and a third row located on both sides of the first row so that the pairs of signal contacts are arranged zigzag on the second connection side.

4 Claims, 28 Drawing Sheets

(51) Int. Cl.

| | |
|---|---|
| ***H01R 13/6471*** | (2011.01) |
| ***H01R 13/6474*** | (2011.01) |
| ***H01R 13/04*** | (2006.01) |
| ***H01R 13/46*** | (2006.01) |
| ***H01R 13/6581*** | (2011.01) |
| ***H01R 24/62*** | (2011.01) |
| ***H01R 12/70*** | (2011.01) |
| *H01R 12/72* | (2011.01) |
| *H01R 13/405* | (2006.01) |
| *H01R 107/00* | (2006.01) |

(52) U.S. Cl.
CPC ..... *H01R 13/46* (2013.01); *H01R 13/6471* (2013.01); *H01R 13/6474* (2013.01); *H01R 13/6581* (2013.01); *H01R 24/62* (2013.01); *H01R 12/724* (2013.01); *H01R 13/405* (2013.01); *H01R 2107/00* (2013.01)

(56) References Cited

U.S. PATENT DOCUMENTS

| | | | | |
|---|---|---|---|---|
| 5,628,639 | A | 5/1997 | Eichholz, Jr. et al. | |
| 6,350,134 | B1 | 2/2002 | Fogg et al. | |
| 6,716,073 | B1 | 4/2004 | Lee | |
| 7,303,410 | B2 | 12/2007 | Saito | |
| 7,448,884 | B2 | 11/2008 | Kato et al. | |
| 7,566,247 | B2 | 7/2009 | Rothermel et al. | |
| 7,591,683 | B2 * | 9/2009 | Zhang | H01R 12/716 439/638 |
| 7,621,788 | B1 | 11/2009 | Feng | |
| 7,674,118 | B2 | 3/2010 | He | |
| 7,824,193 | B2 | 11/2010 | Oyake et al. | |
| 7,988,487 | B2 | 8/2011 | Nomiyama et al. | |
| 8,376,783 | B2 | 2/2013 | Kondo et al. | |
| 8,528,204 | B2 | 9/2013 | Sakamoto | |
| 9,093,792 | B2 | 7/2015 | Shiratori et al. | |
| 2007/0099512 | A1 | 5/2007 | Sato | |
| 2007/0149058 | A1 * | 6/2007 | Saito | H01R 23/688 439/108 |
| 2009/0209120 | A1 | 8/2009 | Tanaka | |
| 2010/0203768 | A1 * | 8/2010 | Kondo | H01R 13/6474 439/676 |
| 2010/0255731 | A1 | 10/2010 | Oyake et al. | |
| 2011/0034079 | A1 * | 2/2011 | Nagata | H01R 13/506 439/607.01 |

FOREIGN PATENT DOCUMENTS

| | | | |
|---|---|---|---|
| CN | 101515674 | A | 8/2009 |
| CN | 101859962 | A | 10/2010 |
| DE | 102007032787 | B4 | 6/2010 |
| JP | S55-037800 | A | 3/1980 |
| JP | S63-150465 | U | 10/1988 |
| JP | 3011823 | U | 6/1995 |
| JP | H10-261459 | A | 9/1998 |
| JP | 3749290 | B2 | 2/2006 |
| JP | 2007-128706 | A | 5/2007 |
| JP | 2008-41656 | A | 2/2008 |
| JP | 4114867 | B2 | 7/2008 |
| JP | 2010-182623 | A | 8/2010 |
| JP | 2011-040224 | A | 2/2011 |
| TW | M383223 | | 6/2010 |

OTHER PUBLICATIONS

Japanese Office Action dated May 7, 2015 in Japanese Application No. 2011-224098 with English translation of the relevant parts.
German Office Action of DE 10 2012 202 706.8, dated Jul. 10, 2013, with English translation.
Taiwan Office Action dated Apr. 11, 2014 with English Translation of Relevant Part.

* cited by examiner

DIFFERENTIAL SIGNAL CONNECTOR CAPABLE OF REDUCING SKEW BETWEEN A DIFFERENTIAL SIGNAL PAIR

CROSS REFERENCE TO RELATED APPLICATIONS

This application is a divisional of and Applicant claims priority under 35 U.S.C. §§120 and 121 of parent U.S. patent application Ser. No. 13/357,157 filed Jan. 24, 2012, which application is based upon and claims the benefit of priority from Japanese Patent Application No. 2011-037321, filed Feb. 23, 2011, Japanese Patent Application No. 2011-224075, filed on Oct. 11, 2011, Japanese Patent Application No. 2011-224098, filed on Oct. 11, 2011, and Japanese Patent Application No. 2011-224139, filed on Oct. 11, 2011, the disclosures of which are incorporated herein in their entirety by reference.

BACKGROUND OF THE INVENTION

1. Field of the Invention

This invention relates to a connector for use in connection of lines adapted to transmit a differential signal pair (hereinafter referred to as a "differential signal connector").

2. Background Art

There is known a differential transmission system adapted to transmit a differential signal pair, comprising signals having opposite phases, in two signal lines forming a pair. Since the differential transmission system has a feature that the data transfer rate can be made high, it has recently been put to practical use in various fields.

For example, in the case of using the differential transmission system for data transfer between a device and a liquid crystal display, the device and the liquid crystal display are each provided with a display port connector which is designed according to the display port standard. As this display port standard, VESA DisplayPort Standard Version 1.0 or its Version 1.1a is known.

This display port connector is a kind of differential signal connector and has a first connection side for connection to a connection partner and a second connection side for connection to a board of the device or the liquid crystal display. The configuration of the first connection side is strictly defined by the display port standard in terms of the relationship with the connection partner while the configuration of the second connection side is relatively free. This type of differential signal connector is disclosed in Patent Document 1 (JP-A-2008-41656).

FIGS. 1A and 1B show a contact assembly 1 incorporated in a conventional differential signal connector which is different from the one disclosed in Patent Document 1 but is similar in configuration thereto. The contact assembly 1 comprises a plurality of pairs of signal contacts 2, a plurality of ground contacts 3, and an insulating housing 4 holding the signal contacts 2 and the ground contacts 3. On the first connection side for connection to a connection partner, the ground contacts 3 are arranged on both sides of each pair of signal contacts 2 so that a fixed-pitch contact array is formed. On the other hand, on the second connection side for connection to a board, the signal contacts 2 and the ground contacts 3 are bent in a direction crossing the contact array so that the signal contacts 2 and the ground contacts 3 are arranged zigzag in two rows.

FIG. 2 shows a board 5 for mounting thereon the differential signal connector including the contact assembly 1 of FIGS. 1A and 1B. The board 5 is formed with a plurality of through holes 6. The through holes 6 are arranged zigzag in two rows so as to correspond to the arrangement of the signal contacts 2 and the ground contacts 3 on the second connection side.

When the differential signal connector is mounted on the board 5, the signal contacts 2 and the ground contacts 3 are respectively inserted into the through holes 6. Lands 7 each in the form of a doughnut-shaped conductor pattern are respectively formed around openings of the through holes 6. Further, wiring patterns 8 are drawn out in parallel along the board 5 from only those lands 7 which are formed corresponding to the through holes 6 adapted to be inserted with the signal contacts 2. Therefore, each signal contact 2 is connected to the wiring pattern 8 through the through hole 6 and the land 7.

In the above-mentioned differential signal connector, arranging the signal contacts and the ground contacts zigzag in two rows on the second connection side, itself, easily makes it possible to reduce the size of the connector. However, if the connector is actually reduced in size this way, there arise the following problems due to the occurrence of a difference in length between the differential signal contacts forming a pair.

As shown in FIG. 3, a plurality of pairs of signal contacts and a plurality of ground contacts can be collectively manufactured by punching a single conductor plate and then carrying out bending. In order to facilitate this manufacturing process, it is common sense of those skilled in the art that forward ends of the contacts are arranged at regular intervals in a bent state and that the number of times of contact bending is set to two. However, in order to arrange the forward ends of the contacts at regular intervals in the bent state, there occurs a difference in length between the differential signal contacts forming a pair as is well seen from a developed state of the contacts shown in FIG. 3. This difference in length causes a propagation time difference (skew) between a differential signal pair in a differential signal connector.

Further, due to this difference in length, there is a case where, on the second connection side, i.e. on a board, the differential signal contacts forming a pair are separated in two rows, i.e. not arranged in the same row. This also applies to the ground contacts arranged on both sides of such a pair of differential signal contacts. In this case, there occurs a difference in length between a pair of wiring patterns connected to such a pair of differential signal contacts, as is also seen from FIG. 2 where there are shown the wiring patterns with different lengths which are drawn out from the lands formed in different rows. This difference in length between the pair of wiring patterns also causes a skew between a differential signal pair.

SUMMARY OF THE INVENTION

It is therefore an exemplary object of this invention to provide a differential signal connector that is small in size and that can reduce a skew between a differential signal pair.

Other objects of the present invention will become clear as the description proceeds.

According to an exemplary aspect of the present invention, there is provided a differential signal connector comprising a plurality of pairs of signal contacts, a plurality of ground contacts, and an insulating housing holding the signal contacts and the ground contacts, wherein the differential signal connector has a first connection side for connection to a connection partner and a second connection side for connection to a board, wherein, on the first connection side, the ground contacts are arranged on both sides of each pair of signal contacts so that a contact array of a fixed pitch is formed, and wherein, on the second connection side, the ground contacts are arranged in a first row so as to be spaced apart from each other, while the pairs of signal contacts, which are adjacently arranged on both sides of the ground contact on the first connection side, are arranged so as to be allocated in a second row and a third row which are located on both sides of the first row so that the pairs of signal contacts are arranged zigzag on the second connection side.

According to another exemplary aspect of the present invention, there is provided a lead frame as an intermediate member for forming a contact group of a connector, comprising a plurality of first leads arranged in a plane, second leads arranged so as to form a pair between the first leads, and a connecting portion connecting the first leads and the second leads on one end side, wherein a pitch of the pair of second leads is made greater on the other end side than on the one end side, and wherein the first leads each have a first straight portion extending from the connecting portion, a first offset portion extending obliquely from the first straight portion so as to be away from the second lead, and a second straight portion extending from the first offset portion in the same direction as the first straight portion.

According to still another exemplary aspect of the present invention, there is provided a differential signal connector comprising a contact group using as an intermediate member the above-mentioned lead frame, wherein the first leads and the second leads are respectively bent in the direction crossing the plane at the first bending intended portions and the second bending intended portions and are respectively bent in the direction crossing the plane at the additional bending intended portions, and wherein the connecting portion is cut off from the first leads and the second leads.

According to yet another aspect of the present invention, there is provided a differential signal connector comprising a plurality of ground contacts arranged at an interval from each other and a plurality of signal contacts arranged so as to form pairs each between the ground contacts, wherein one end of each of the ground contacts and one end of each of the signal contacts are adjacently arranged in a plane on a first connection side of the connector, wherein the ground contacts and the signal contacts extend in parallel to each other from the ends and then are bent at a right angle in the same direction at positions offset from each other, wherein, on a second connection side of the connector, the other ends of the adjacent ground contacts are located at both ends of a long side of a trapezoid while the other ends of the signal contacts forming each pair are located at both ends of a short side of the trapezoid, wherein, in order to increase a distance between the other ends of the signal contacts forming each pair, both signal contacts are bent outward away from each other in the vicinity of the other ends thereof, and wherein the ground contacts each have an offset portion between its portion bent at the right angle and the other end thereof.

BRIEF DESCRIPTION OF THE DRAWINGS

FIGS. 1A and 1B show a contact assembly incorporated in a conventional differential signal connector, wherein FIG. 1A is a perspective view and FIG. 1B is a bottom view;

FIGS. 4A to 4D show a state where a differential signal connector according to a first embodiment of this invention is mounted on a board, wherein FIG. 4A is a front view, FIG. 4B is a right side view, FIG. 4C is a bottom view, and FIG. 4D is a cross-sectional view taken along line Id-Id of FIG. 4A;

FIGS. 5A to 5D show a lower contact assembly incorporated in the differential signal connector of FIGS. 4A to 4D, wherein FIG. 5A is a perspective view, FIG. 5B is a right side view, FIG. 5C is a rear view, and FIG. 5D is a bottom view;

DETAILED DESCRIPTION OF PREFERRED EMBODIMENTS

Referring to FIGS. 4A to 8, a differential signal connector 10 according to a first embodiment of this invention will be described.

FIGS. 4A to 4D show a state where the differential signal connector 10 is mounted on a printed board 11. The differential signal connector 10 is a printed board mount-type 20-pin connector having contacts in upper and lower two rows and is mounted on the printed board 11 when it is used. The front side, for connection to a mating connector (not illustrated) serving as a connection partner, of the differential signal connector 10 is called a first connection side, while its bottom side for connection to the printed board 11 is called a second connection side: On the first connection side, a fitting projection 12 is provided for fitting to the mating connector. The fitting projection 12 has a shape extending laterally in parallel to the connector fitting plane. The second connection side will be described in detail later.

Figure 1A:
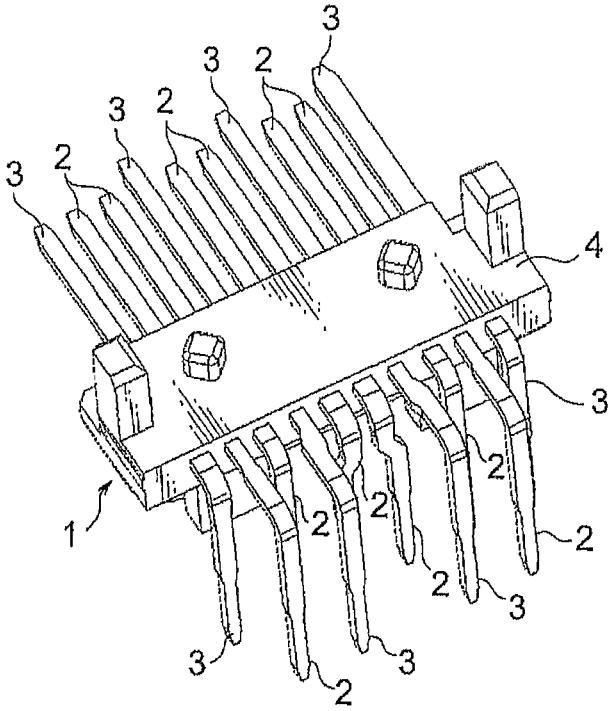
Figure 1B:
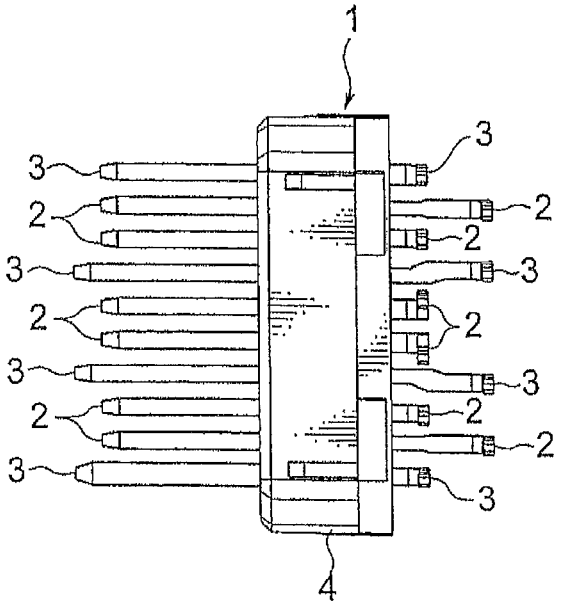
Figure 2:
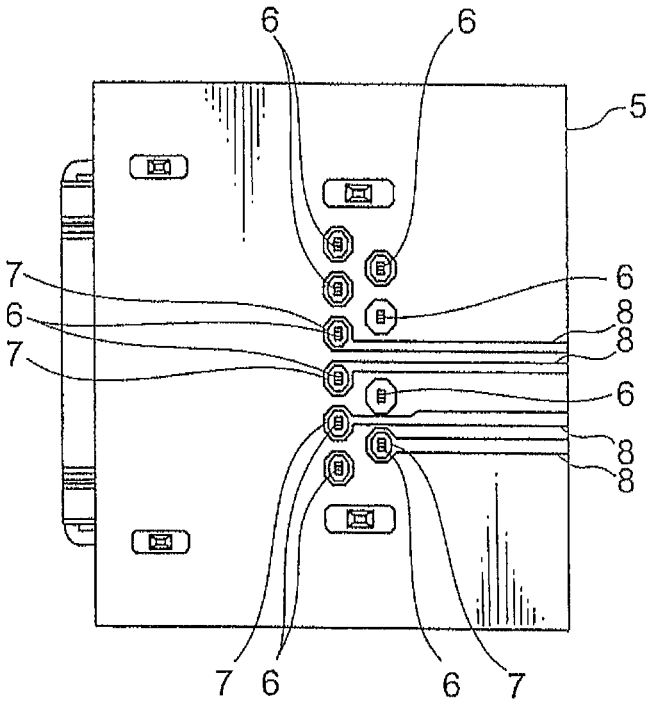
FIG. 2 is a bottom view of a board for mounting thereon the conventional differential signal connector.
Figure 3:
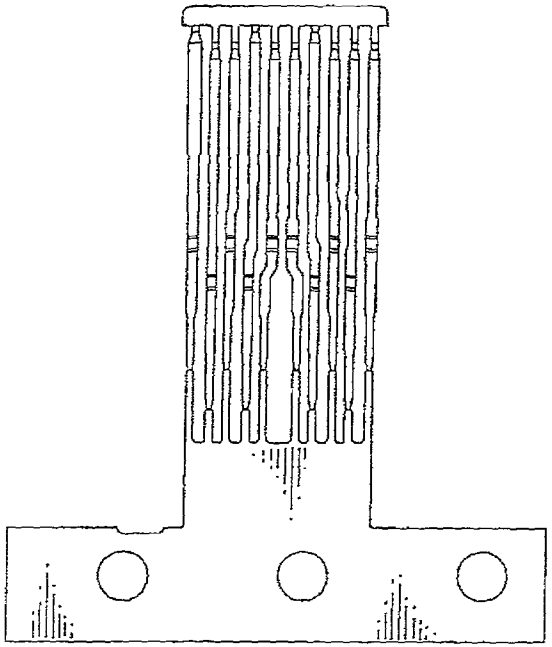
FIG. 3 is a contact development view (a lead frame with a carrier) in the manufacture of signal contacts and ground contacts included in the contact assembly of FIGS. 1A and 1B.
Figure 4B:
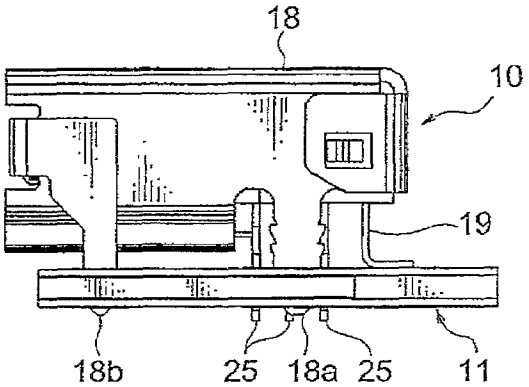
Figure 4D:
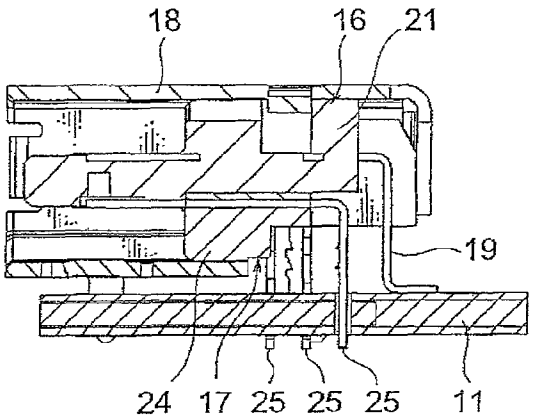
Figure 4A:
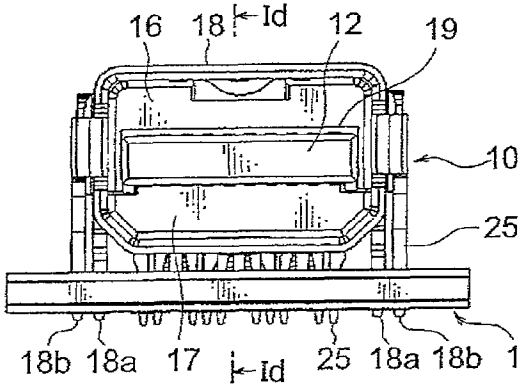
Figure 4C:
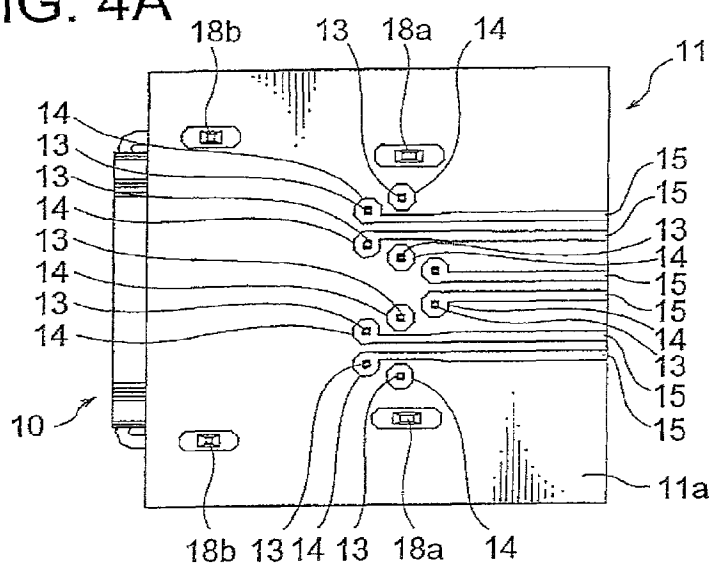
Figure 5B:
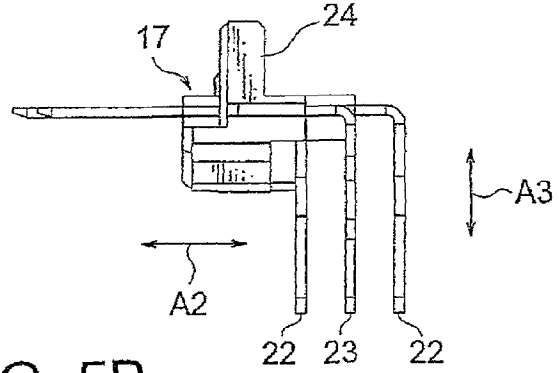
Figure 5D:
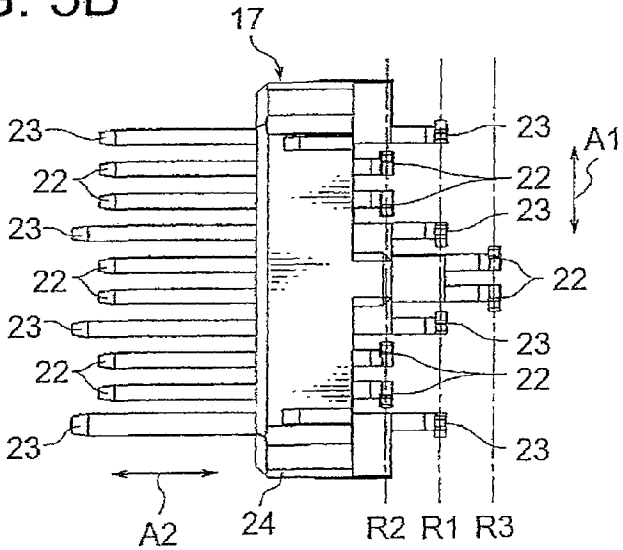
Figure 5A:
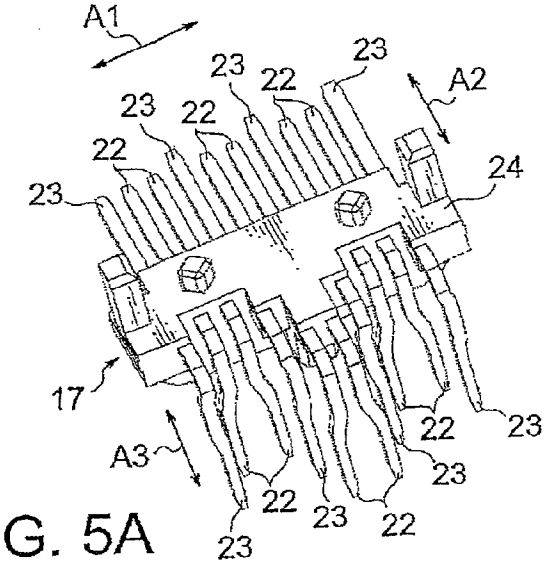
Figure 5C:
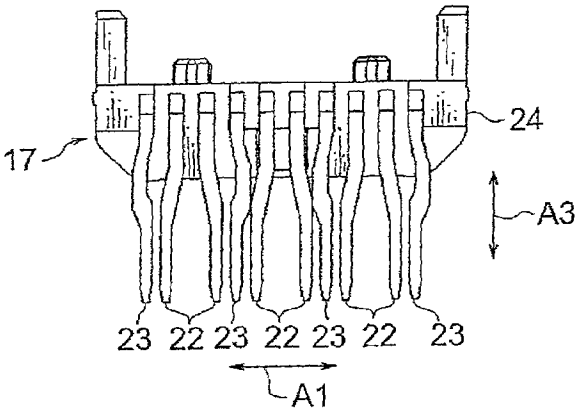

The printed board 11 used herein is a multilayer board. The printed board 11 is formed with a number of through holes 13 as seen from FIG. 4C showing a lower surface 11*a* of the printed board 11. Lands 14 each in the form of a doughnut-shaped conductor pattern are respectively formed around openings of the through holes 13. Further, wiring patterns 15 are drawn out in parallel along the board 11 from some of the lands 14. The positions and roles of the through holes 13 will be clarified later.

The differential signal connector 10 comprises an upper contact assembly 16, a lower contact assembly 17, and a conductive connector shell 18 surrounding the upper and lower contact assemblies 16 and 17 as a whole. The upper contact assembly 16 comprises a number of conductive upper contacts 19, called additional contacts herein, and an insulating upper housing 21 holding the upper contacts 19. The upper contacts 19 have forward ends arranged in the upper part of the fitting projection 12, then extend rearward, and then are bent downward at a right angle so that lower ends of the upper contacts 19 are soldered to wiring patterns on an upper surface (not illustrated) of the printed board 11 in an SMT structure. The connector shell 18 has two pairs of fixing legs 18*a* and 18*b* adapted to be fixed to the printed board 11. By engagement of the fixing legs 18*a* and 18*b* with the printed board 11, the differential signal connector 10 is firmly fixed to the printed board 11. The lower contact assembly 17 will be described in detail later.

Next, referring to FIGS. 5A to 5D in addition to FIGS. 4A to 4D, the lower contact assembly 17 will be described in detail.

The lower contact assembly 17 comprises three pairs of conductive signal contacts 22, four conductive ground contacts 23, and an insulating lower housing 24 holding the signal contacts 22 and the ground contacts 23. On the first connection side of the lower housing 24, there is formed a contact array of a fixed pitch (preferably 0.7 mm or less in a miniaturized display port connector) which extends in a first direction A1 in a state where the ground contacts 23 are arranged on both sides of each pair of signal contacts 22.

All of the signal contacts 22 and the ground contacts 23 extend rearward in a second direction A2 perpendicular to the first direction A1 to pass through the lower housing 24 and then are bent at a right angle on the opposite side of the lower housing 24 to extend downward in a third direction A3 perpendicular to the first and second directions A1 and A2. In the following description, the signal contacts 22 and the ground contacts 23 may also be collectively called lower contacts 25.

As seen from FIGS. 4A to 4D, on the first connection side of the differential signal connector 10, the lower contacts 25 are arranged in the lower part of the fitting projection 12 so as to face the upper contacts 19 at a distance therefrom. As a consequence, the mating connector is brought into contact with the upper contacts 19 and the lower contacts 25 when it is fitted to the fitting projection 12, so that the mating connector is electrically connected to the differential signal connector 10. Herein, a portion, which is brought into contact with the mating connector, of each lower contact 25 is called a connector contact portion.

On the other hand, on the second connection side of the differential signal connector 10, the lower contacts 25 are respectively inserted into the through holes 13 of the printed board 11 and are respectively connected to the lands 14 by soldering on the lower surface 11*a* of the printed board 11. Since the lower contacts 25 are soldered on the lower surface 11*a* of the printed board 11, the soldering condition can be easily checked visually when the differential signal connector 10 is mounted on the printed board 11. Herein, a portion, which is inserted into the through hole 13, of each lower contact 25 is called a board connecting portion.

When the cross-sectional shape of the lower contact 25 is square, the diameter of the through hole 13 of the printed board 11 is designed to be at least slightly greater than a diagonal length of the lower contact 25. Further, the lands 14 are formed around the through holes 13 and it is necessary to ensure insulation between the adjacent through holes 13. Taking these into account, it is preferable to set an interval of about 0.8 mm for the through holes 13.

In FIGS. 5A to 5D, the board connecting portions of the lower contacts 25 are arranged in three parallel rows which extend in the second direction A2 and which are spaced apart from each other in the first direction A1. Specifically, the board connecting portions of the ground contacts 23 are arranged in a first row R1 so as to be spaced apart from each other, while the pairs of signal contacts 22 whose connector contact portions are arranged between the ground contacts 23 are arranged so as to be allocated in a second row R2 and a third row R3 which are located on both sides of the first row R1. As a result, as is well seen from FIGS. 5A to 5D, the board connecting portions of the pairs of signal contacts 22 are arranged zigzag on both sides of the first row R1.

Herein, the signal contacts 22 arranged in the second row R2 are designed to have substantially the same length, while the signal contacts 22 arranged in the third row R3 are designed to have substantially the same length. That is, the lengths of the pair of signal contacts 22 arranged in the same row are set to be equal to each other. Then, the pairs of signal contacts 22 are allocated to the second row R2 and the third row R3 by the difference in bending thereof from each other, specifically, the difference in bending position thereof from each other, between the first connection side and the second connection side. The ground contacts 23 are arranged in the first row R1 by the difference in bending position thereof from the signal contacts 22 between the first connection side and the second connection side. Instead of providing the difference in bending position, the signal contacts 22 and the ground contacts 23 can be arranged in three rows on the second connection side by the difference in number of times of bending or both may be jointly used.

Further, on the second connection side, each pair of signal contacts 22 are arranged at a position corresponding to between the adjacent ground contacts 23 and, further, the pitch of each pair of signal contacts 22 is designed to be slightly greater than the pitch of the contact array.

On the second connection side, the ground contacts 23 are each arranged at a position corresponding to between the pairs of signal contacts 22 and, further, the ground contacts 23 and the pairs of signal contacts 22, which are adjacently arranged on both sides of each ground contact 23 on the first connection side, are arranged in directions obliquely crossing the first, second, and third rows R1, R2, and R3.

On the other hand, naturally, the through holes 13 of the printed board 11 are formed at positions corresponding to the above-mentioned arrangement of the signal contacts 22 and the ground contacts 23 on the second connection side.

Herein, each pair of the adjacent signal contacts 22 are for connecting lines adapted to transmit a differential signal pair comprising signals having opposite phases and thus will be respectively called a +Sig contact and a −Sig contact in the following description. Further, among the through holes 13, the through hole 13 adapted to be inserted with the +Sig contact will be called a +Sig through hole, the through hole 13 adapted to be inserted with the −Sig contact will be called a −Sig through hole, and the through hole 13 adapted to be inserted with the ground contact 23 will be called a GND through hole. Further, among the wiring patterns 15, the wiring pattern 15 connected to the +Sig through hole will be called a +Sig wiring pattern and the wiring pattern 15 connected to the −Sig through hole will be called a −Sig wiring pattern.

According to the differential signal connector described above, since the +Sig through hole and the −Sig through hole are arranged in parallel to the connector fitting plane, the +Sig wiring pattern and the −Sig wiring pattern can be formed as wiring patterns extending rearward of the connector and being equal in length and parallel to each other on the lower surface 11*a* of the printed board 11 as the multilayer board. As a consequence, the skew between the differential signal pair is small. Although the description has been given of the case where the lines adapted to transmit the pair of differential signals are connected, this also applies to the case where a plurality of pairs of differential signals are transmitted. The same effect can be obtained.

Figure 6:
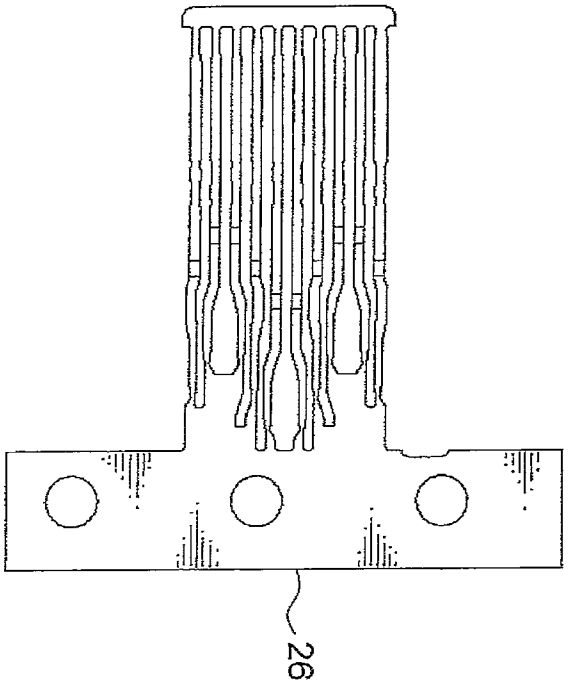
FIG. 6 is a plan view of a member for use in the manufacture of signal contacts and ground contacts included in the lower contact assembly of FIGS. 5A to 5D.

The contact group as a gathering of the three pairs of conductive signal contacts 22 and the four conductive ground contacts 23 can be easily formed from a single conductor plate by pressing. In this case, the shape shown in FIG. 6 is first obtained. Then, a carrier 26 is cut off, thereby forming a lead frame 30 shown in FIGS. 7 and 8 as one example of an intermediate member.

Figure 7:
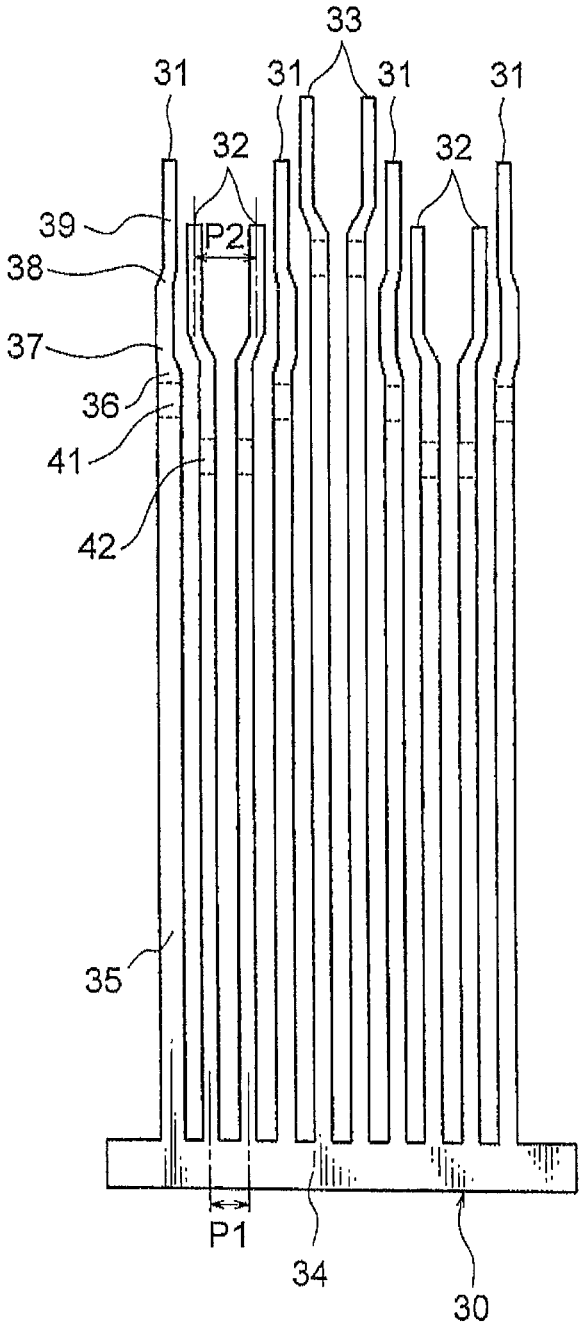
FIG. 7 is a plan view of a lead frame obtained by cutting off a carrier from the member of FIG. 6.
Figure 8:
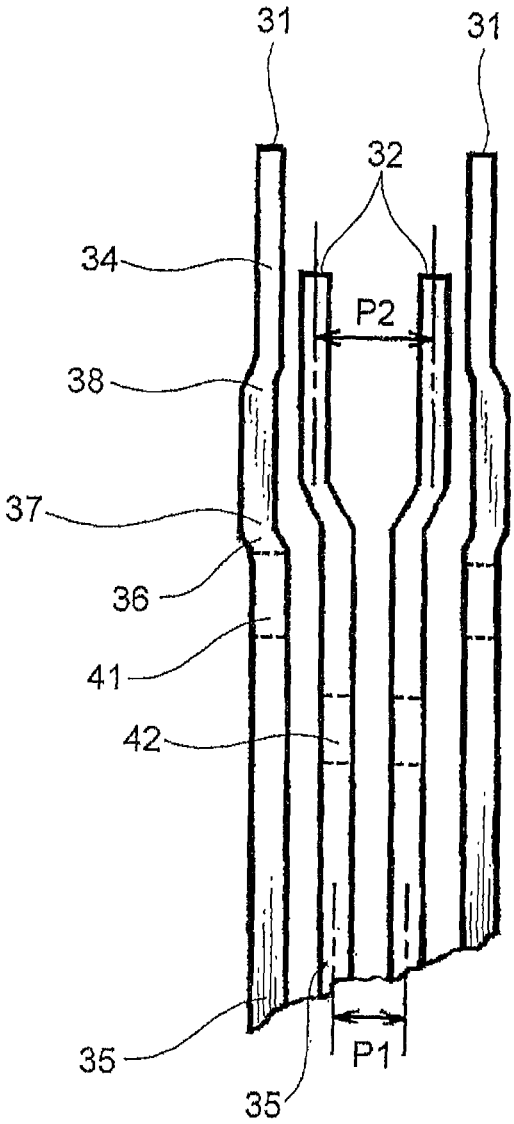
FIG. 8 is an enlarged view of a main portion of FIG. 7.

In FIGS. 7 and 8, the lead frame 30 comprises a plurality of first leads 31 arranged in a plane, second leads 32 arranged so as to form pairs each between the first leads 31, third leads 33 arranged so as to form a pair between the first leads 31, and a connecting portion 34 connecting the first leads 31, the second leads 32, and the third leads 33 on one end side. The length of the second lead 32 from the connecting portion 34 is made shorter than that of the first lead 31. The length of the third lead 33 from the connecting portion 34 is made longer than that of the first lead 31. Further, when punching a metal plate, a pitch P2 of each of the pairs of second leads 32 and the pair of third leads 33 on the other end side, i.e. on the free end side, is made greater than a P1 thereof on the one end side, so that each pair of leads 32, 33 approach the first leads 31 on the free end side.

The first leads 31 each have a first straight portion 35 extending from the connecting portion 34, a first offset portion 36 extending obliquely from the first straight portion 35 so as to be away from a portion, with the greater pitch P2, of the second lead 32, a second straight portion 37 extending from the first offset portion 36 in the same direction as the first straight portion 35, a second offset portion 38 extending obliquely from the second straight portion 37 so as to approach the second lead 32, and a third straight portion 39 extending from the second offset portion 38 on an extension line of the first straight portion 35.

Further, the first leads 31 each have, in the first straight portion 35, a first bending intended portion 41 for bending in a direction crossing the above-mentioned plane. The second leads 32 each have, at a position between its portion with the greater pitch P2 and the connecting portion 34 and adjacent to the portion with the greater pitch P2, a second bending intended portion 42 for bending in the direction crossing the above-mentioned plane.

In the lead frame 30 of FIGS. 7 and 8, although the portions with the greater pitch P2 are provided on the free end side of the second leads 32 forming each pair, the distance between each first lead 31 and the corresponding second lead 32 can be made relatively large due to the presence of the first offset portion 36. As a consequence, the lead frame 30 can be easily manufactured by press-punching.

Further, the lead frame 30 is bent at the first bending intended portions 41 and the second bending intended portions 42 and then the connecting portion 34 is cut off. In this way, it is possible to easily obtain the contact group comprising the six signal contacts 22 and the four ground contacts 23 of the lower contact assembly shown in FIGS. 5A to 5D.

Since the greater pitch P2 is provided on the free end side of each of the pairs of second leads 32 and the pair of third leads 33 in the lead frame 30, the distance between the signal contacts 22 in the second and third rows R2 and R3 in FIGS. 5A to 5D is made large so that it is possible to easily provide the through holes and the lands in the printed board 11 with sufficient electrical insulation therebetween. In addition, since the ground contacts 23 and the first and second signal contacts 22 are arranged in the three different rows, it is possible to set the distance therebetween to be large and thus to sufficiently ensure electrical insulation between differential signal pairs. As a consequence, it is possible to easily achieve pitch-narrowing of the contact group.

Further, since each first lead 31 is provided with the first offset portion 36 that extends obliquely so as to be away from the portion, with the greater pitch P2, of the corresponding second lead 32, it is possible to make large the distance between the second straight portion 37 following the first offset portion 36 and the portion, with the greater pitch P2, of the second lead 32. As a consequence, punching is easily applied and thus it is possible to provide the lead frame 30 that contributes to the manufacture of a narrow-pitch contact group.

Referring to FIGS. 9 to 12, a first modification of the differential signal connector described above will be described. The same reference symbols are assigned to the same or similar portions, thereby omitting explanation thereof.

This first modification comprises an upper contact assembly 16, a lower contact assembly 17, and an insulating locator 43 incorporated in a connector shell 18.

A number of upper contacts 19 each have a horizontal portion 19*a* arranged on an upper surface of a fitting projection 12, a bent portion 19*b* exposed rearward of an upper housing 21 from a rear end of the horizontal portion 19*a* and bent downward, a vertical portion 19*c* extending vertically downward from the bent portion 19*b*, and a connecting portion 19*d* bent at a right angle from a lower end of the vertical portion 19*c* and adapted to be soldered to a wiring pattern on an upper surface of a mounting object such as a printed board in an SMT structure. Hereinbelow, the upper contacts 19 may also be collectively called a contact group.

The upper contacts 19 are held by the upper housing 21 at portions of the horizontal portions 19*a* by insert molding. The portion, held by the upper housing 21, of each horizontal portion 19*a* is called a holding portion herein.

A substantially rectangular parallelepiped dielectric 44 is attached to the vertical portions 19*c* of the upper contacts 19 by insert molding. The dielectric 44 covers most of each vertical portion 19*c* in a contact manner from the outside so as to be integral with the upper contacts 19. As a result, the arrayed state of the contact group is held by the dielectric 44. Further, engaging projections 44*a* are respectively formed at both ends, in an array direction of the contact group, of the dielectric 44. The portion, covered with the dielectric 44, of each vertical portion 19*c* is called an intermediate portion herein.

Like the lower contact assembly of the differential signal connector which has been described with reference to FIG. 4A to 8, the lower contact assembly 17 comprises an insulating lower housing 24 and a number of conductive lower contacts 25 including signal contacts 22 and ground contacts 23 which are held in array by the lower housing 24. The lower housing 24 has a pair of posts 24*a* for positioning with the upper housing 21. The lower contacts 25 each have a horizontal portion 25*a* arranged along a lower surface of the fitting projection 12 of the upper housing 21 and a vertical portion 25*b* exposed rearward of the lower housing 24 and extending vertically downward. A lower end portion of the vertical portion 25*b* of the lower contact 25 serves as a terminal portion 25*c* adapted to be inserted into each of through holes formed in the mounting object and fixed by soldering.

The locator 43 has on its lower surface a pair of positioning bosses 45 for fitting into positioning holes (not illustrated) of the mounting object. The locator 43 has on its rear surface a recess 46 which coincides with the shape and size of the dielectric 44. On mutually opposite side surfaces of the recess 46, engaging projections 46*a* corresponding to the engaging projections 44*a* of the dielectric 44 are formed. Further, a key groove 46*b* is formed on a bottom surface of the recess 46.

The connector shell 18 has a plurality of fixing legs 18*a* and 18*b*. By engagement of the fixing legs 18*a* and 18*b* with the mounting object, a differential signal connector 10 is firmly fixed to the mounting object.

Figure 13A:
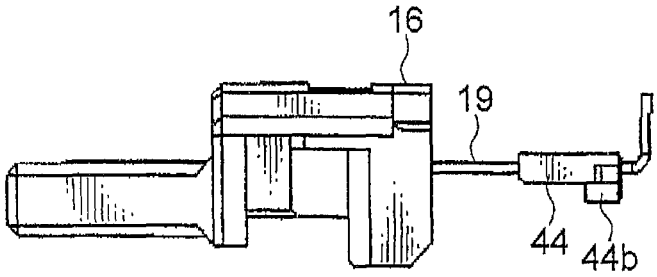
FIGS. 13A and 13B are diagrams for explaining one process in the manufacture of the differential signal connector of FIG. 9.
Figure 13B:
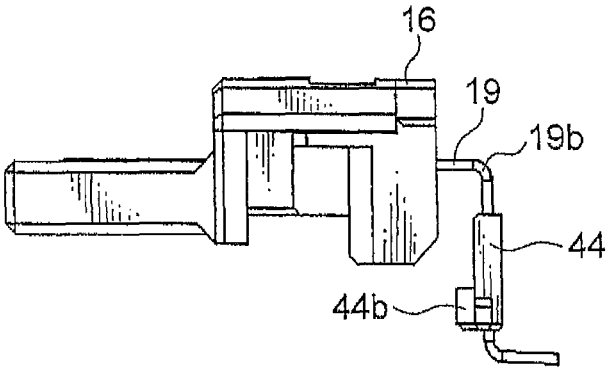

Herein, referring also to FIGS. 13A and 13B, a method of manufacturing the upper contact assembly 16 will be described. Before forming the bent portions 19*b* in the upper contacts 19, the upper housing 21 and the dielectric 44 are simultaneously insert-molded with respect to the contact group, thereby obtaining a configuration shown in FIG. 13A. Then, the contact group is subjected to bending, thereby forming the bent portions 19*b* as shown in FIG. 13B. In this event, since both sides of the bent portions 19*b* are integrally held by the upper housing 21 and the dielectric 44, the contact group can be easily bent into a predetermined shape without misaligning the contact group. Symbol 44*b* denotes a key corresponding to the key groove 46*b*.

As described above, it is advantageous in terms of the manufacturing process to simultaneously insert-mold the upper housing 21 and the dielectric 44 with respect to the contact group. However, alternatively, the upper housing 21 and the dielectric 44 may be formed separately.

Figure 14:
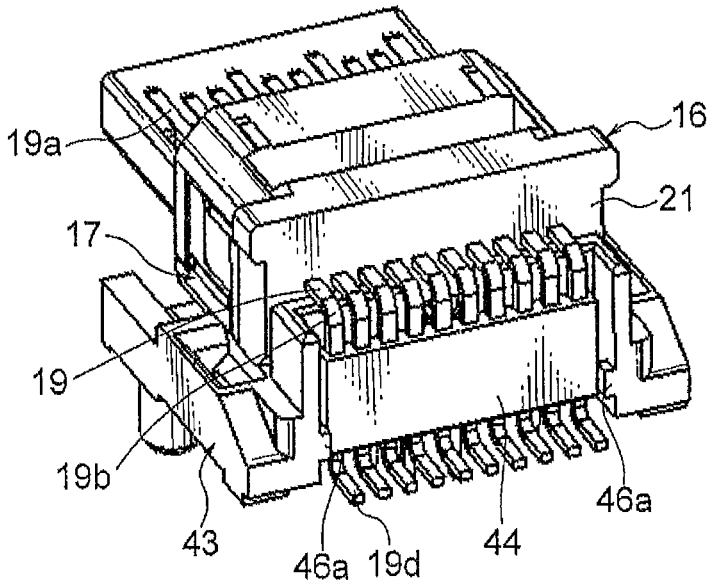
FIG. 14 is a perspective view showing an assembled state of internal components of the differential signal connector of FIG. 9.

FIG. 14 shows a state where the upper contact assembly 16 and the lower contact assembly 17 are mounted to the locator 43. When mounting the upper contact assembly 16 to the locator 43, the dielectric 44 is inserted into the recess 46 of the locator 43 while fitting the key 44*b* shown in FIGS. 13A and 13B into the key groove 46*b* shown in FIG. 11. After the insertion, the dielectric 44 is fixedly fitted in the recess 46 by engagement of the engaging projections 44*a* with the engaging projections 46*a*.

Figure 9:
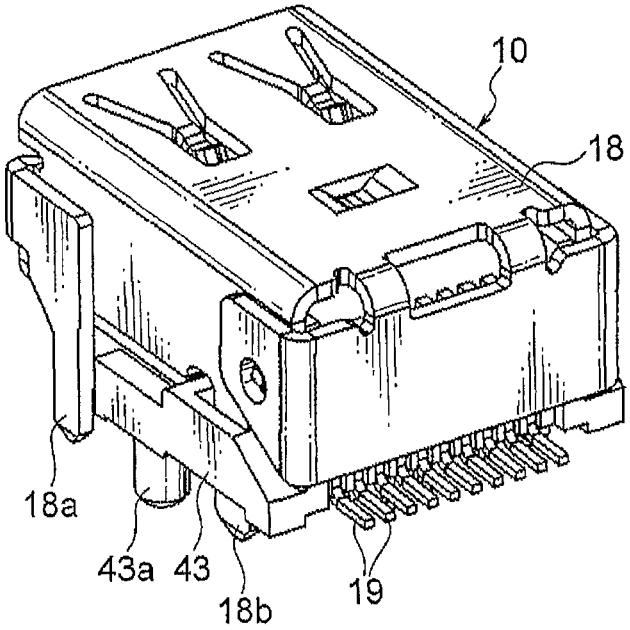
FIG. 9 is an external perspective view of a first modification of the differential signal connector of FIGS. 4A to 4D.
Figure 10:
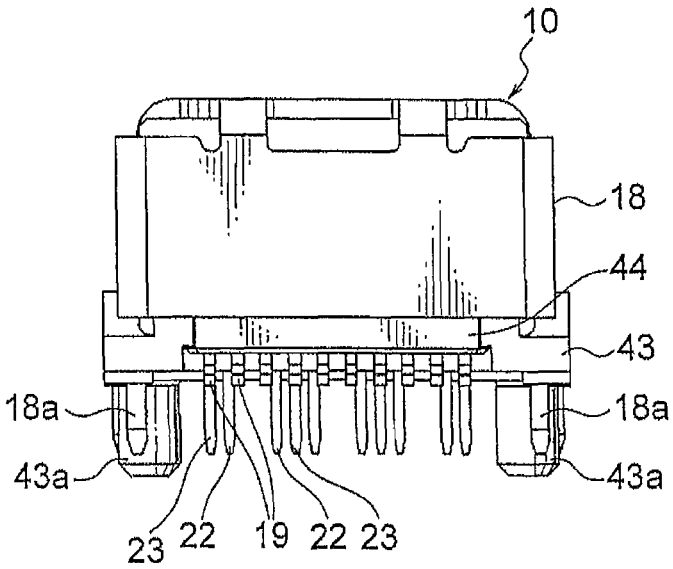
FIG. 10 is a rear view of the differential signal connector of FIG. 9.
Figure 11:
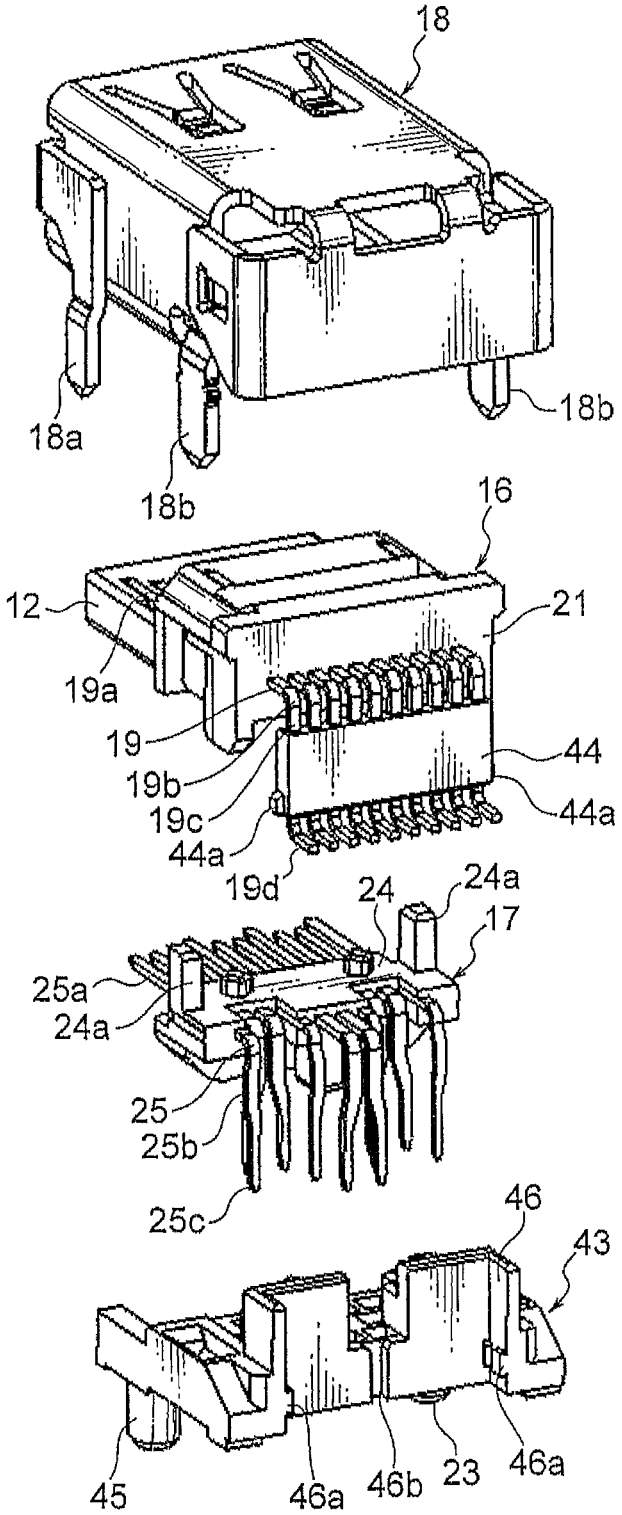
FIG. 11 is an exploded perspective view, seen from one direction, of the differential signal connector of FIG. 9.
Figure 12:
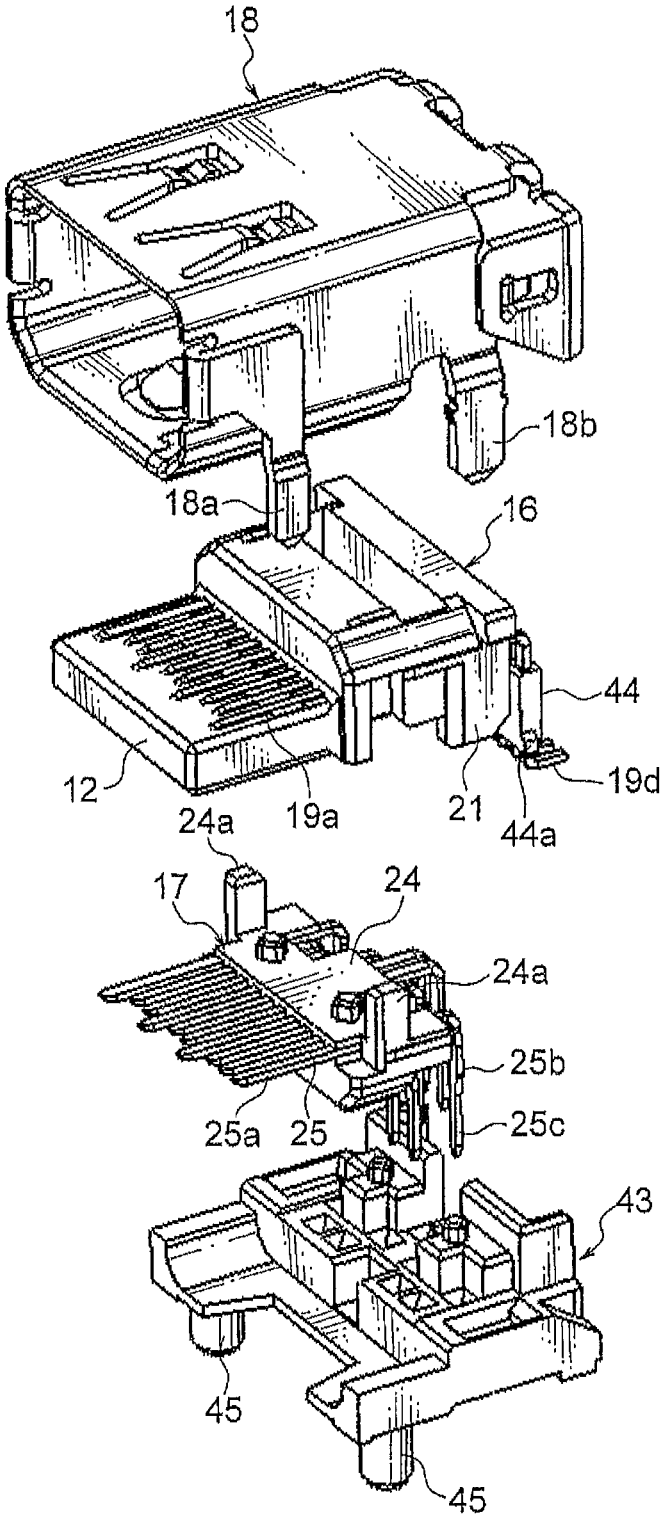
FIG. 12 is an exploded perspective view, seen from another direction, of the differential signal connector of FIG. 9.

Further, the upper contact assembly 16, the lower contact assembly 17, and the locator 43 are collectively surrounded by the connector shell 18, so that the connector 10 shown in FIGS. 9 and 10 is obtained. It is to be noted that the locator 43 is partially projected and exposed to the outside of the connector shell 18 on both sides of the connector 10.

According to the differential signal connector described with reference to FIGS. 9 to 14, since it is configured such that the portions, exposed from the upper housing 21, of the upper contacts 19 are covered by the insert molding of the dielectric 44 in the contact manner and that the dielectric 44 is fitted and coupled to the locator 43 adapted to be positioned with respect to the mounting object, it is possible to achieve impedance matching and to prevent positional deviation of the connecting portions 19*d* of the upper contacts 19. Further, since the locator 43 is partially projected to the outside of the connector shell 18, the surface mounting of the connector with high positional accuracy is enabled by image recognition of the projected portions.

Figure 15:
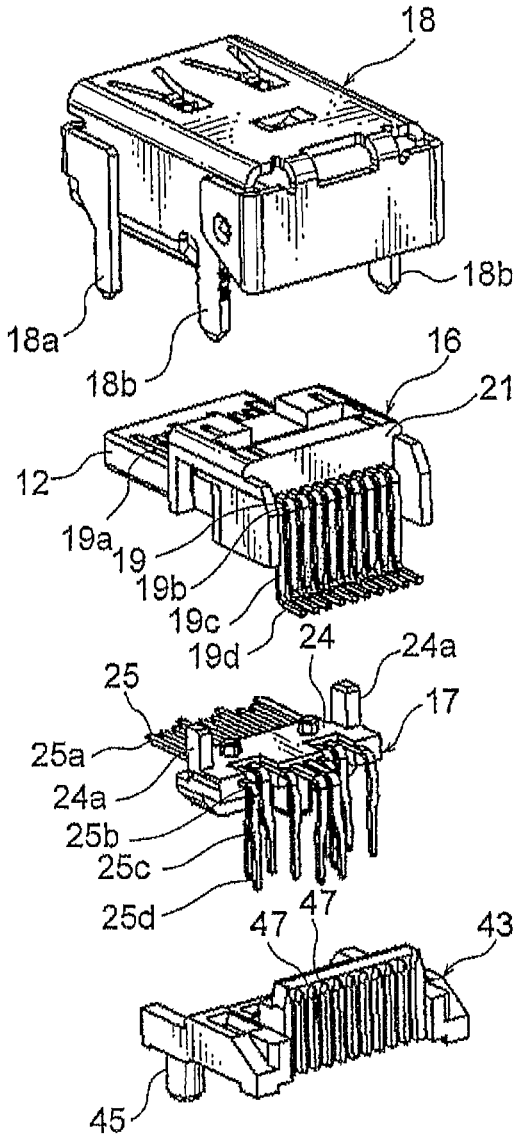
FIG. 15 is an exploded perspective view of a second modification of the differential signal connector of FIGS. 4A to 4D.
Figure 16:
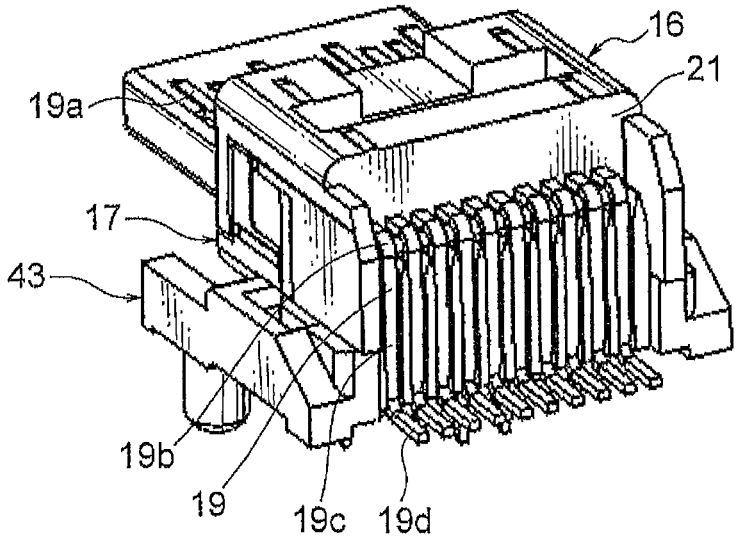
FIG. 16 is a perspective view showing an assembled state of internal components of the differential signal connector of FIG. 15.

Referring to FIGS. 15 and 16, a second modification of the differential signal connector described above will be described. The same reference symbols are assigned to the same or similar portions, thereby omitting explanation thereof.

In FIG. 15, before mounting an upper contact assembly 16, vertical portions 19*c* of upper contacts 19 are entirely exposed to the outside. On the other hand, a rear surface of a locator 43 is formed with a plurality of parallel grooves 47 which are arranged at the same pitch as the vertical portions 19*c* and extend vertically. These grooves 47 each have a size that can receive substantially the entirety of the vertical portion 19*c* of the upper contact 19 with a little gap. Therefore, the operation of inserting the vertical portions 19*c* into the grooves 47 is easy.

FIG. 16 shows a state where the upper contact assembly 16 and a lower contact assembly 17 are mounted to the locator 43. When mounting the upper contact assembly 16 to the locator 43, the vertical portions 19*c* of the upper contacts 19 are respectively inserted into the grooves 47 of the locator 43. As a result, an effect is achieved similar to that of the dielectric 44 of the differential signal connector 10 described with reference to FIGS. 9 to 14. Thereafter, a resin having a permittivity equal to or different from that of the locator 43 is filled in the grooves 47 so as to cover substantially the entirety of the vertical portions 19*c* of the upper contacts 19 and then is cured so that the degree of freedom of impedance adjustment becomes high. The portion, covered with the cured resin, of each vertical portion 19*c* is called an intermediate portion herein.

Also in this modification, there is obtained a connector having the same external appearance as the differential signal connector 10 of FIG. 9.

According to the connector described with reference to FIGS. 15 and 16, since it is configured such that the dielectric in the form of the cured resin covers the portions, exposed from an upper housing 21, of the upper contacts 19 in a contact manner and is coupled to the locator 43 adapted to be positioned with respect to a mounting object, it is possible to achieve impedance matching and to prevent positional deviation of connecting portions 19*d* of the upper contacts 19. Further, since the locator 43 is partially projected to the outside of a connector shell 18, the surface mounting of the connector with high positional accuracy is enabled by image recognition of the projected portions.

Figure 17:
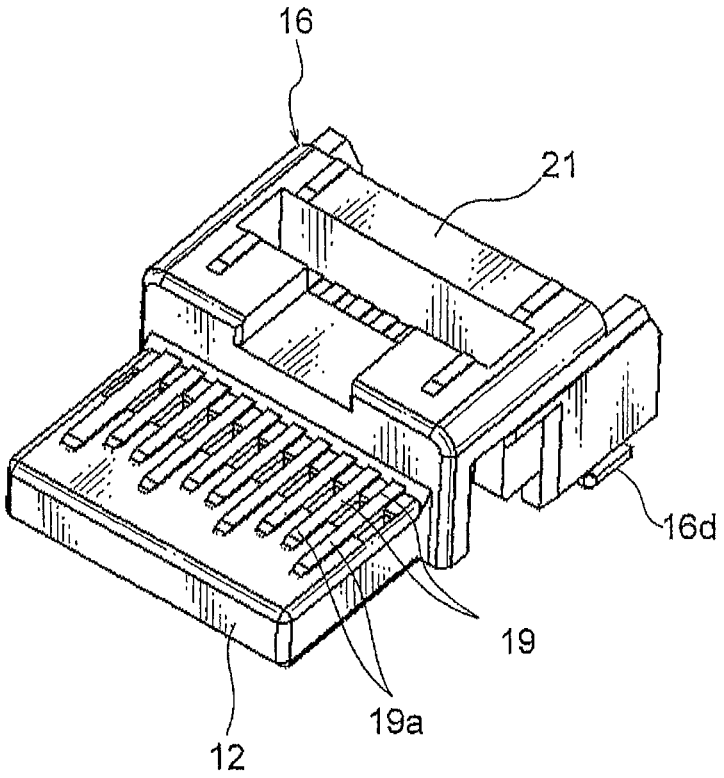
FIG. 17 is a perspective view of an upper contact assembly as one component of the differential signal connector of FIG. 15.

FIG. 17 is a perspective view, seen from a different direction, of the upper contact assembly 16 as one component of the differential signal connector of FIG. 15. The same reference symbols are assigned to the same or similar portions, thereby omitting explanation thereof.

Figure 18:
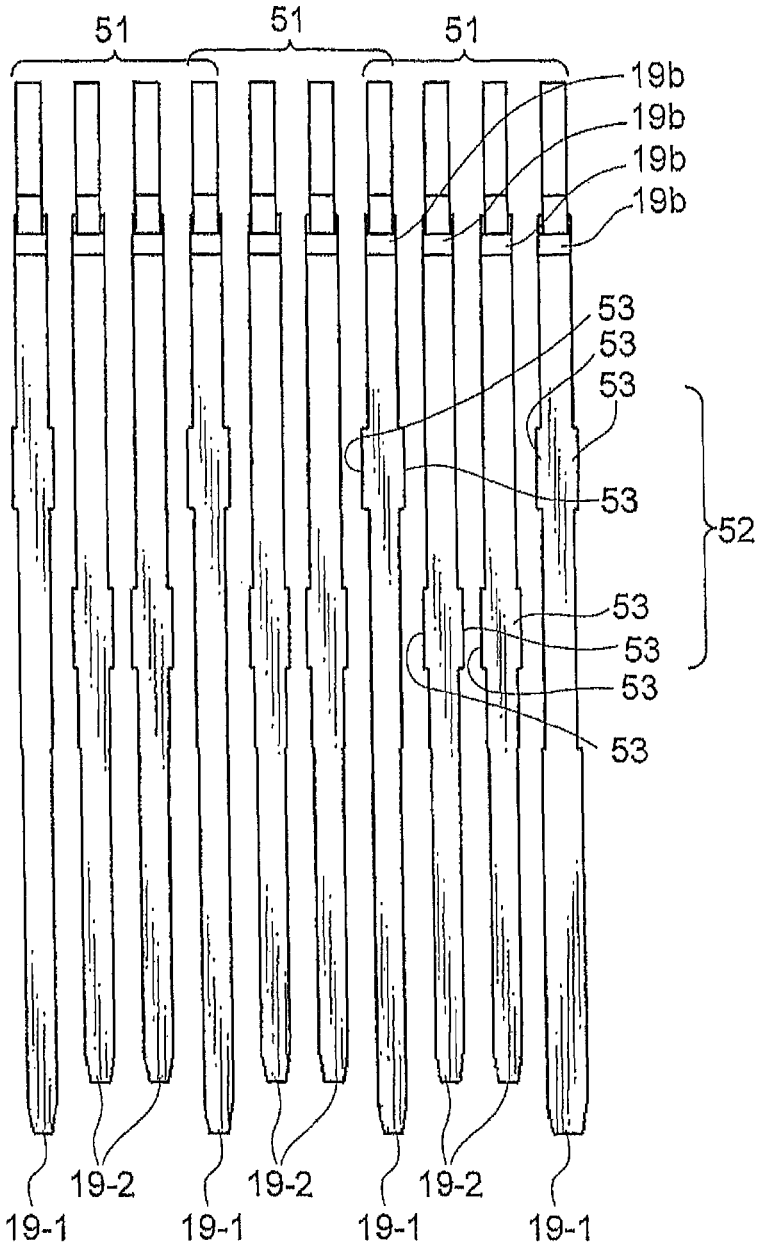
FIG. 18 is a plan view showing one example of a contact group included in the upper contact assembly of FIG. 17.

Referring to FIG. 18, a first example of a contact group included in the upper contact assembly 16 will be described.

The contact group of FIG. 18 comprises four ground contacts 19-1 arranged so as to be spaced apart from each other and six signal contacts 19-2 arranged so as to form three pairs each between the ground contacts 19-1. The ground contacts 19-1 are each used for connection to a ground line while the signal contacts 19-2 are each used for connection to a signal line. The four contacts arranged in the order of the ground contact 19-1, the signal contact 19-2, the signal contact 19-2, and the ground contact 19-1 form one contact set 51 and, by repeating the contact sets 51 while partially overlapping each other, the contact group is formed. Since all the contact sets 51 have the same structure, only one of them will be described herein.

In all of the intermediate two signal contacts 19-2 and the two ground contacts 19-2 on both sides thereof, bent portions 19*b* are provided at the same position in the longitudinal direction of the contacts. That is, the bent portions 19*b* are provided in one row in an array direction of the contacts. Accordingly, on one end side in the longitudinal direction of the contacts (lower side in FIG. 18), the four contacts of the contact set 51 are arranged in one row along an upper surface of a fitting projection 12 as shown in FIG. 17, while, on the other end side (upper side in FIG. 18), the four contacts of the contact set 51 are inserted into the grooves 47 of the locator 43 shown in FIG. 15 so as to be arranged in one row along the rear surface of the locator 43.

Further, the four contacts of the contact set 51 respectively have holding portions 52 adapted to be held by the upper housing 21 of FIG. 17 by insert molding. That is, by the engagement of the holding portions 52 with the upper housing 21, the contact group is firmly held by the upper housing 21.

The holding portion 52 of each contact is provided with a plurality of (two in this example) projecting portions 53 as one kind of a differently shaped portion that changes the contact width. In each contact, the projecting portions 53 are integrally formed at corresponding positions of both side surfaces of the contact so as to be symmetric with respect to the center of the contact. The forming positions of the projecting portions 53 in the longitudinal direction of the contacts differ from each other between the ground contact 19-1 and the signal contact 19-2. In the illustrated example, the projecting portions 53 of the ground contact 19-1 are formed on the side close to the bent portion 19*b* in the holding portion 52 while the projecting portions 53 of the signal contact 19-2 are formed on the side far from the bent portion 19*b* in the holding portion 52. This, however, may be reversed. At any rate, the projecting portions 53 are formed to be symmetric with respect to the center of the array of the intermediate two signal contacts 19-2, i.e. with respect to the center of the array of the four contacts.

Since the projecting portions 53 are formed to be symmetric as described above, the symmetry of differential signal transmission lines comprising the four contacts is maintained and, therefore, the high-frequency characteristics of the connector are not degraded by providing the projecting portions 53. Further, since the projecting portions 53 are formed at the plurality of different positions in the longitudinal direction of the contacts, the distance between the adjacent contacts can be made relatively large and thus pressing is easily applied.

Figure 19:
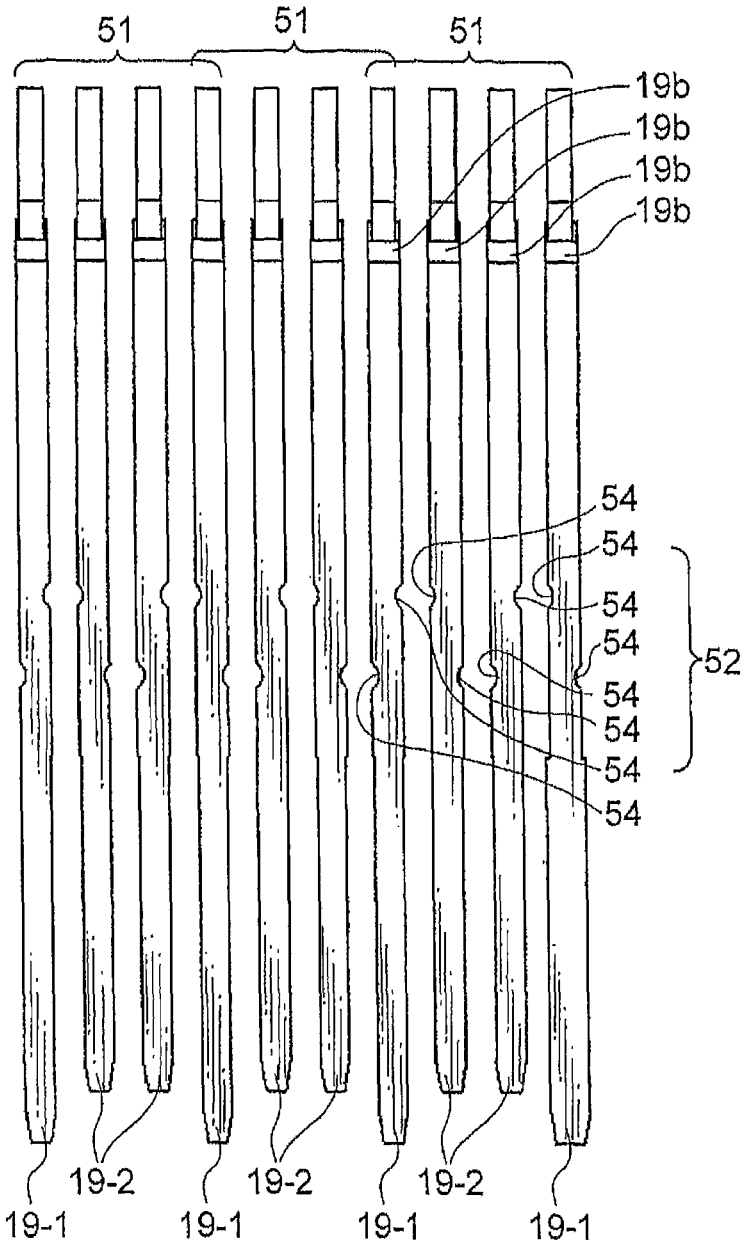
FIG. 19 is a plan view showing another example of a contact group included in the upper contact assembly of FIG. 17.

Referring to FIG. 19, a second example of a contact group included in the upper contact assembly 16 will be described. The same reference symbols are assigned to the same or similar portions as those in FIG. 18, thereby omitting explanation thereof.

Also in the contact group of FIG. 19, in all of intermediate two signal contacts 19-2 and two ground contacts 19-2 on both sides thereof, bent portions 19*b* are provided at the same position in the longitudinal direction of the contacts. That is, the bent portions 19*b* are provided in one row in an array direction of the contacts. Accordingly, on one end side in the longitudinal direction of the contacts (lower side in FIG. 19), the four contacts of a contact set 51 are arranged in one row along an upper surface of a fitting projection 12 as shown in FIG. 17, while, on the other end side (upper side in FIG. 19), the four contacts of the contact set 51 are inserted into the grooves 47 of the locator 43 shown in FIG. 15 so as to be arranged in one row along the rear surface of the locator 43.

A holding portion 52 of each contact is provided with a plurality of (two in this example) cutouts 54 as one kind of a differently shaped portion that changes the contact width. In each contact, although the cutouts 54 are provided on both side surfaces, the cutouts 54 are formed at different positions in the longitudinal direction of the contact so as to be asymmetric with respect to the center of the contact. The forming positions of the cutouts 54 in the longitudinal direction of the contacts differ from each other between the adjacent contacts. At any rate, the cutouts 54 are formed to be symmetric with respect to the center of the array of the intermediate two signal contacts 19-2, i.e. with respect to the center of the array of the four contacts.

Since the cutouts 54 are formed to be symmetric as described above, the symmetry of differential signal transmission lines comprising the four contacts is maintained and, therefore, the high-frequency characteristics of the connector are not degraded by providing the cutouts 54. Further, since the cutouts 54 are formed at the plurality of different positions in the longitudinal direction of the contacts, the distance between the adjacent contacts can be made relatively large and thus pressing is easily applied.

Figure 20:
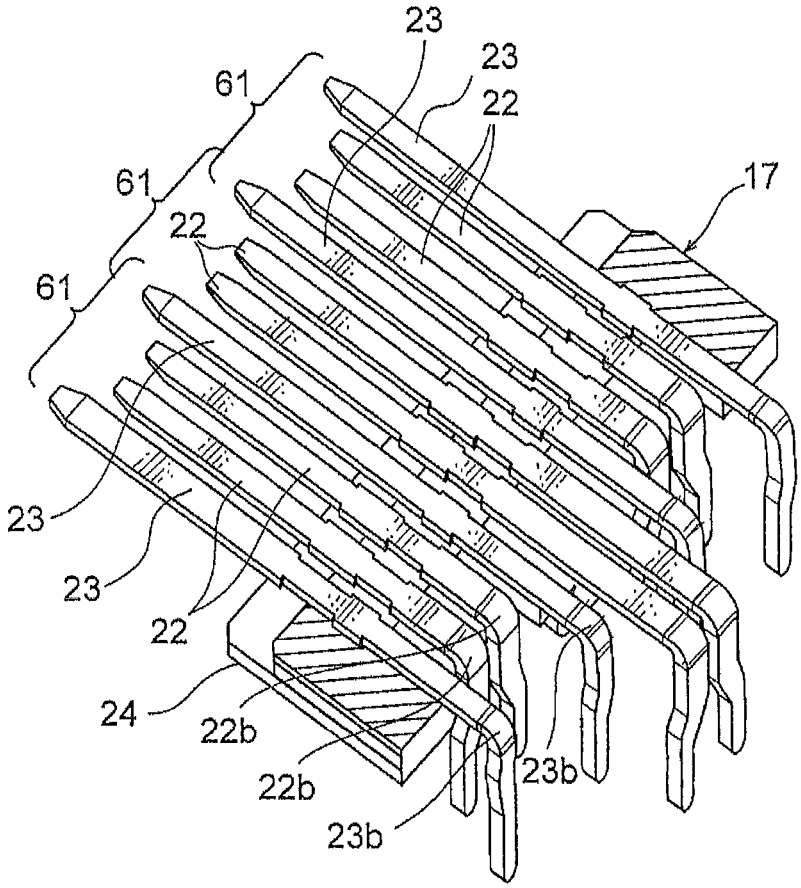
FIG. 20 is a cross-sectional perspective view of a lower contact assembly as one component of the differential signal connector of FIG. 15.
Figure 21:
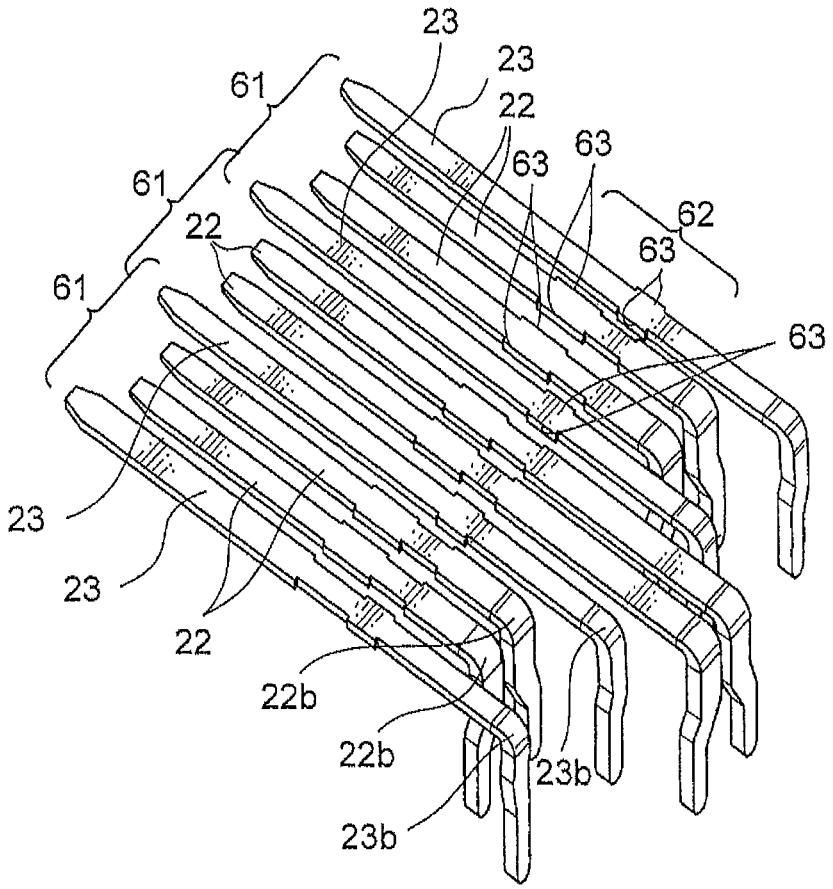
FIG. 21 is a perspective view of only a contact group included in the lower contact assembly of FIG. 20.

Referring to FIGS. 20 and 21, one example of a contact group included in the lower contact assembly 17 will be described.

In the contact group shown in FIGS. 20 and 21, three pairs of signal contacts 22 are respectively arranged between four ground contacts 23 which are arranged so as to be spaced apart from each other. The ground contacts 23 are each used for connection to a ground line while the signal contacts 22 are each used for connection to a signal line. The four contacts arranged in the order of the ground contact 23, the signal contact 22, the signal contact 22, and the ground contact 23 form one contact set 61 and, by repeating the contact sets 61 while partially overlapping each other, the contact group is formed. Since all the contact sets 61 have the same structure, only one of them will be described herein.

In the intermediate two signal contacts 22 and the two ground contacts 23 on both sides thereof, bent portions 22*b* and 23*b* are provided at different positions in the longitudinal direction of the contacts. Accordingly, on one end side in the longitudinal direction of the contacts (upper left side in FIG. 20), the four contacts of the contact set 61 are arranged in one row along one plane, while, on the other end side (lower right side in FIG. 20), the pair of signal contacts 22 and the two ground contacts 23 on both sides thereof are arranged in different rows, i.e. in the rows R1-R3 in FIGS. 5A to 5D. Further, the pitch of the intermediate two signal contacts 22 is made greater on the other end side than on the one end side.

Further, the four contacts of the contact set 61 respectively have holding portions 62 adapted to be held by a lower housing 24 by insert molding. That is, by the engagement of the holding portions 62 with the lower housing 24, the contact group is firmly held by the lower housing 24.

The holding portion 62 of each contact is provided with a plurality of (two in this example) projecting portions 63 as one kind of a differently shaped portion that changes the contact width. The function of these projecting portions 63 is the same as that of the projecting portions 53 in the contact group shown in FIG. 18.

Since the projecting portions 63 of the contact group included in the lower contact assembly 17 are also formed to be symmetric, the symmetry of differential signal transmission lines comprising the four contacts is maintained and, therefore, the high-frequency characteristics of the connector are not degraded by providing the projecting portions 63. Further, since the projecting portions 63 are formed at a plurality of different positions in the longitudinal direction of the contacts, the distance between the adjacent contacts can be made relatively large and thus pressing is easily applied.

Also in the contact group included in the lower contact assembly 17, cutouts which are the same as the cutouts 54 in the contact group shown in FIG. 19 can be provided instead of the projecting portions 63. It is needless to say that the same function and effect can be obtained also in that case.

Figure 22:
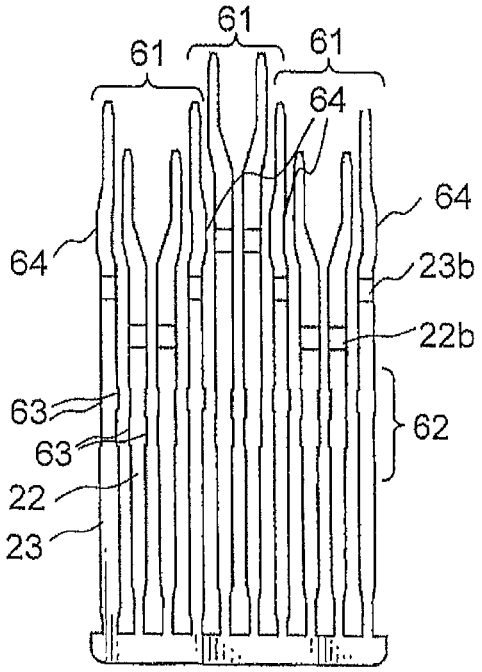
FIG. 22 is a plan view of one example of a lead frame used in the manufacture of the contact group of FIG. 21.
Figure 23:
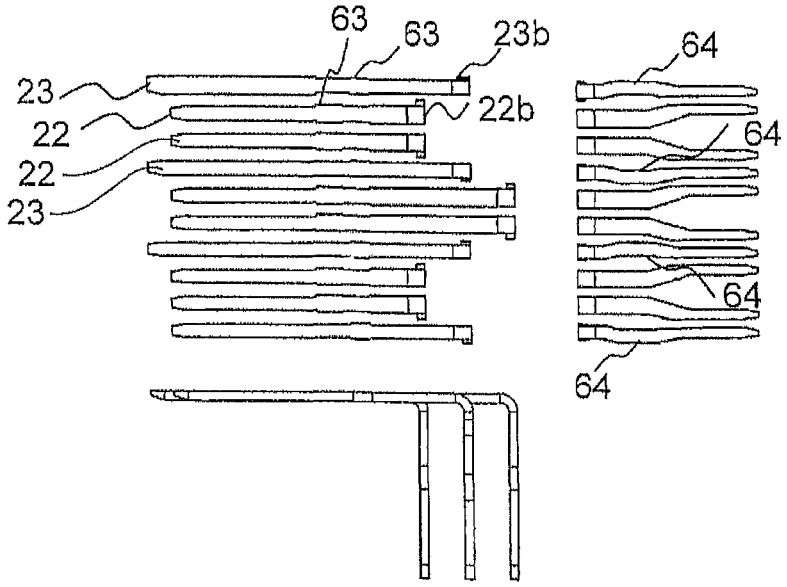
FIG. 23 shows three views of the contact group of FIG. 21.

FIG. 22 is a plan view showing a state where a single metal plate is pressed into a lead frame and FIG. 23 shows three views of the contact group of FIG. 21 obtained from the lead frame of FIG. 22. In the contact set 61, the two ground contacts 23 on both sides of the intermediate two signal contacts 22 are respectively provided with escape portions 64 being away from the intermediate two signal contacts 22, at the position where the pitch of the intermediate two signal contacts 22 is increased. As a result, since the distance between the signal contact 22 and the ground contact 23 is made large at the position where the escape portion 64 is provided, the formation by pressing is facilitated.

Next, referring to FIGS. 24 and 25, a connector 70 according to a second embodiment of this invention will be described.

This connector 70 is a differential signal connector adapted to be mounted on a printed board 71 at its end portion. The connector 70 comprises a number of conductive upper contacts (contact group) 72, a number of conductive lower contacts 73, an insulating housing 74 holding the contacts 72 and 73, and a conductive connector shell 75 surrounding them. The printed board 71 is formed with a cutout 71*a* at its end portion. The contacts 72 and 73 are respectively arranged in a direction perpendicular to the sheet surface in FIG. 25.

The housing 74 has a first portion 74*a* adapted to be inserted into the cutout 71*a* of the printed board 71 and a second portion 74*b* extending from the first portion 74*a* along a lower surface of the printed board 71. Each upper contact 72 extends in the first portion 74*a* and then in the second portion 74*b* with bending and has a terminal portion 72*a* which passes through a through hole formed in the printed board 71 so as to be connected by soldering. Each lower contact 73 extends in the first portion 74*a* and then in the second portion 74*b* with bending and has a terminal portion 73*a* which is connected by soldering to the lower surface of the printed board 71. A mating connector (not illustrated) serving as a connection partner is fitted to the first portion 74*a* so as to be electrically connected to the upper contacts 72 and the lower contacts 73.

Figure 26:
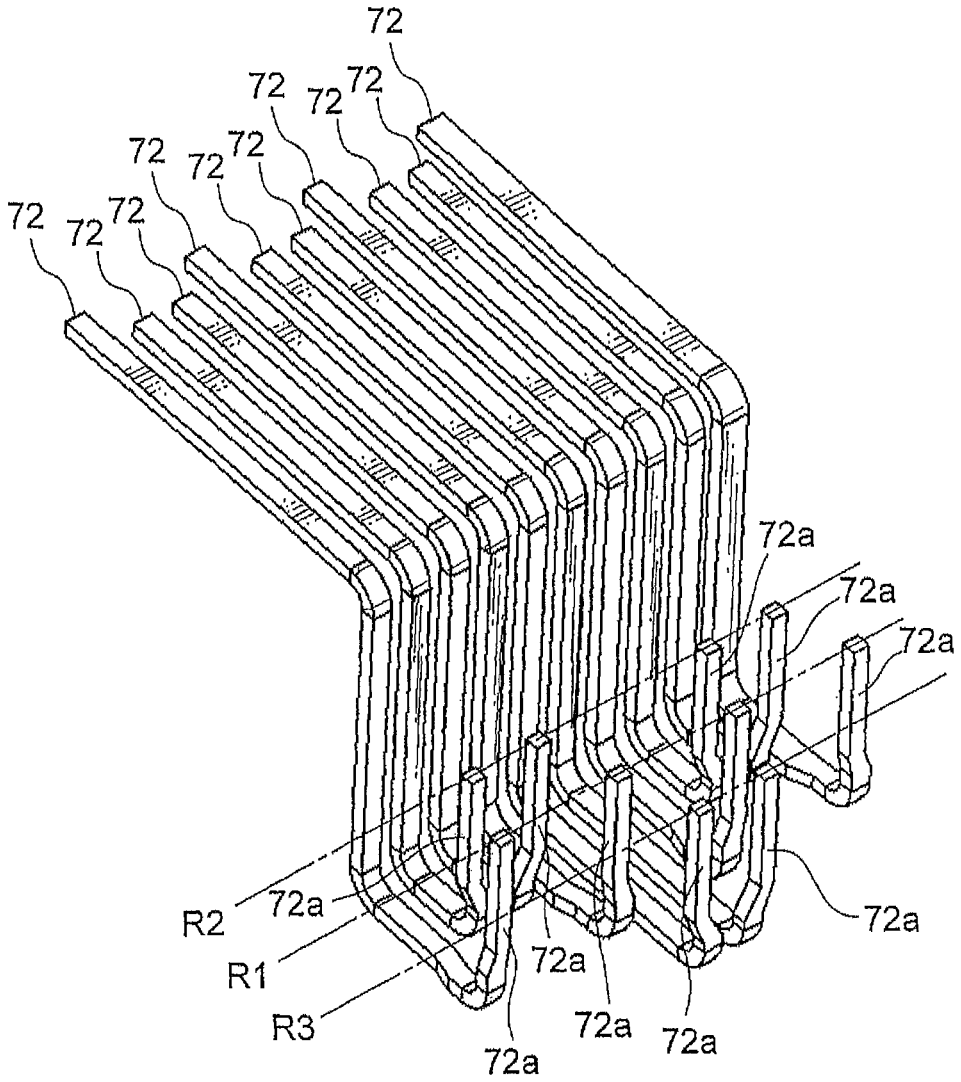
FIG. 26 is a perspective view of a contact group included in the differential signal connector of FIGS. 24 and 25.

Referring to FIG. 26, only the upper contacts 72 are collectively shown as a contact group. As seen from FIG. 26, the upper contacts 72 are divided into three kinds based on the positions of the terminal portions 72*a*. That is, the terminal portions 72*a* are arranged in three rows. The upper terminal 72 whose terminal portion 72*a* is arranged in an intermediate row R1 is called a ground contact. The upper terminal 72 whose terminal portion 72*a* is arranged in a row R2 on one side of the intermediate row R1 is called a first signal contact. The upper terminal 72 whose terminal portion 72*a* is arranged in a row R3 on the other side of the intermediate row R1 is called a second signal contact. Accordingly, the contact group of FIG. 26 comprises four ground contacts, four first signal contacts, and two second signal contacts. The ground contacts are each connected to a ground line of the printed board 71 while the first and second signal contacts are each connected to a signal line of the printed board 71.

As shown in FIG. 26, on the first connection side of the connector, one end of each of the ground contacts and one end of each of the signal contacts are adjacently arranged in a plane. Then, the ground contacts and the signal contacts extend in parallel to each other and then are bent at a right angle in the same direction at positions offset from each other. As a consequence, on the second connection side of the connector, the other ends (terminal portions 72*a*) of the adjacent ground contacts are located at both ends of the long side of a trapezoid while the other ends (terminal portions 72*a*) of the signal contacts forming each pair are located at both ends of the short side of the trapezoid. Further, in order to increase the distance between the other ends (terminal portions 72*a*) of the signal contacts forming each pair, both signal contacts are slightly bent outward away from each other in the vicinity of the other ends (terminal portions 72*a*) thereof as will be clarified later.

Figure 27:
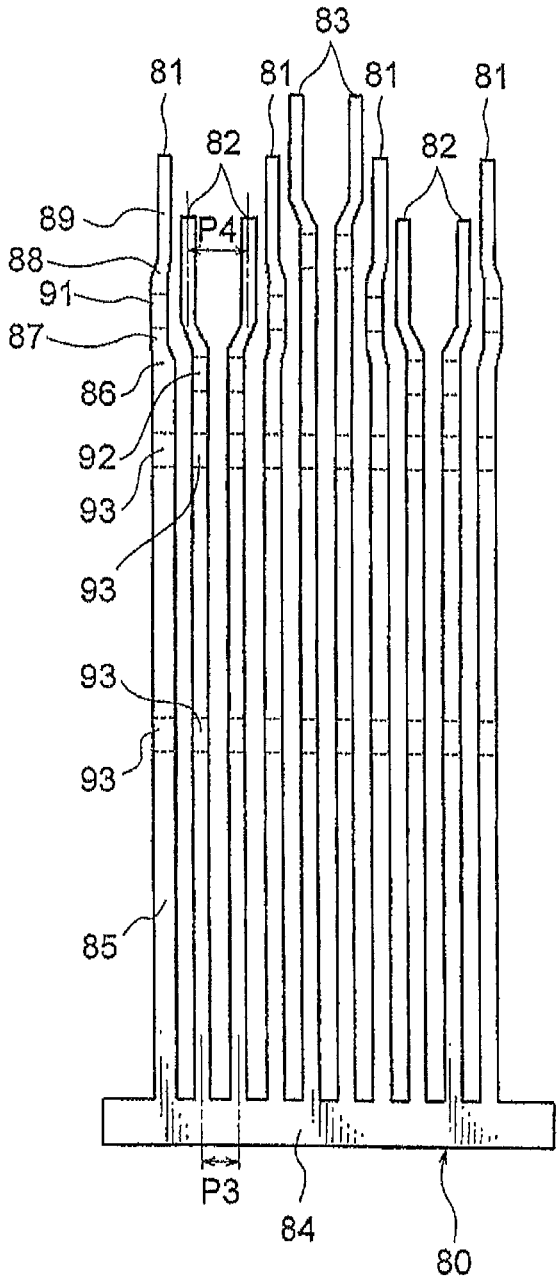
FIG. 27 is a plan view of a lead frame used in the manufacture of the contact group of FIG. 26.
Figure 28:
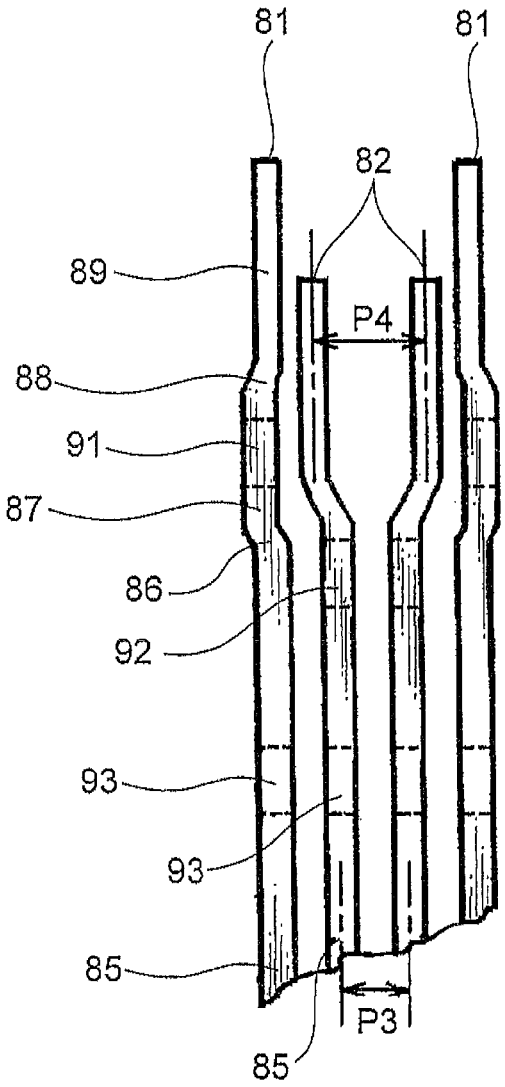
FIG. 28 is an enlarged view of a main portion of FIG. 27.

Referring to FIGS. 27 and 28, a lead frame 80 is shown as one example of an intermediate member for use in the manufacture of the above-mentioned contact group.

The lead frame 80 is manufactured by punching a metal plate and comprises a plurality of first leads 81 arranged in a plane, second leads 82 arranged so as to form pairs each between the first leads 81, third leads 83 arranged so as to form a pair between the first leads 81, and a connecting portion 84 connecting the first leads 81, the second leads 82, and the third leads 83 on one end side. The length of the second lead 82 from the connecting portion 84 is made shorter than that of the first lead 81. The length of the third lead 83 from the connecting portion 84 is made longer than that of the first lead 81. Further, when punching the metal plate, a pitch P4 of each of the pairs of second leads 82 and the pair of third leads 83 on the other end side, i.e. on the free end side, is made greater than a pitch P3 thereof on the one end side, so that each pair of leads 82, 83 approach the first leads 81 on the free end side.

The first leads 81 each have a first straight portion 85 extending from the connecting portion 84, a first offset portion 86 extending obliquely from the first straight portion 85 so as to be away from a portion, with the greater pitch P4, of the second lead 82, a second straight portion 87 extending from the first offset portion 86 in the same direction as the first straight portion 85, a second offset portion 88 extending obliquely from the second straight portion 87 so as to approach the second lead 82, and a third straight portion 89 extending from the second offset portion 88 on an extension line of the first straight portion 85.

Further, the first leads 81 each have, in the second straight portion 87, a first bending intended portion 91 for bending in a direction crossing the above-mentioned plane. The second leads 82 each have, at a position between its portion with the greater pitch P4 and the connecting portion 84 and adjacent to the portion with the greater pitch P4, a second bending intended portion 92 for bending in the direction crossing the above-mentioned plane.

Further, the first leads 81 and the second leads 82 each have a plurality of additional bending intended portions 93 between the connecting portion 84 and the first offset portion 86 or between the connecting portion 84 and the second bending intended portion 92.

In the lead frame 80 of FIG. 27, although the portions with the greater pitch P4 are provided on the free end side of the second leads 82 forming each pair, the distance between each first lead 81 and the corresponding second lead 82 can be made relatively large due to the presence of the first offset portion 86. As a consequence, the lead frame 80 of FIG. 27 can be easily manufactured by press-punching.

Then, the lead frame 80 of FIG. 27 is bent at the first bending intended portions 91, the second bending intended portions 92, and the additional bending intended portions 93 and then the connecting portion 84 is cut off. In this way, it is possible to easily obtain the contact group of FIG. 26 comprising the four ground contacts, the four first signal contacts, and the two second signal contacts.

Since the greater pitch P4 is provided on the free end side of each of the pairs of second leads 82 and the pair of third leads 83 in the lead frame 80 of FIG. 27, the distance between the terminal portions 72*a* is made large in the rows R2 and R3 of the contact group of FIG. 26 so that electrical insulation can be sufficiently ensured between the adjacent first signal contacts and between the second signal contacts. In addition, since the terminal portions 72*a* of the ground contacts and the first and second signal contacts are arranged in the three different rows, it is possible to set the distance therebetween to be large and thus to sufficiently ensure electrical insulation therebetween. As a consequence, it is possible to easily achieve pitch-narrowing of the contact group.

Further, since each first lead 81 is provided with the first offset portion 86 that extends obliquely so as to be away from the portion, with the greater pitch P4, of the corresponding second lead 82, it is possible to make large the distance between the second straight portion 87 following the first offset portion 86 and the portion, with the greater pitch P4, of the second lead 82. As a consequence, punching is easily applied and thus it is possible to provide the lead frame 80 that contributes to the manufacture of a narrow-pitch contact group.

Further, since the first bending intended portion 91 is provided in the second straight portion 87 (between the first offset portion 86 and the second offset portion 88), the distance from the first bending intended portion 91 to the free end, i.e. the length of the terminal portion 72*a* in FIG. 26, is shortened as a result. Accordingly, it is possible to easily achieve a reduction in the height of the connector.

Figure 29:
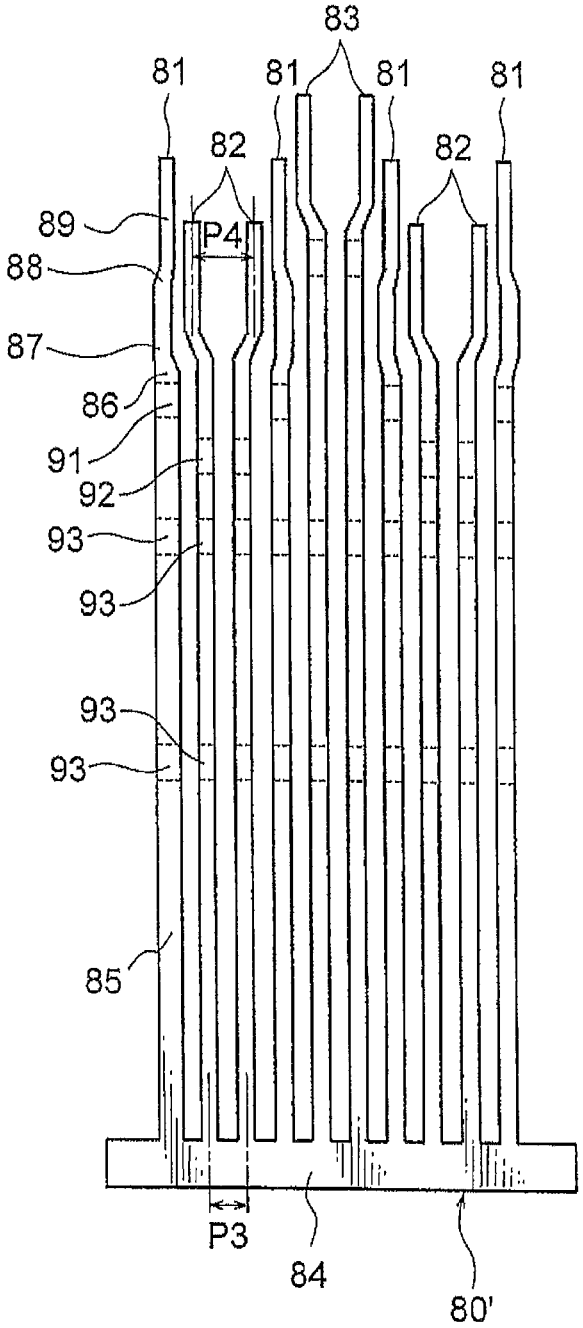
FIG. 29 is a plan view of a modification of the lead frame used in the manufacture of the contact group of FIG. 26.
Figure 30:
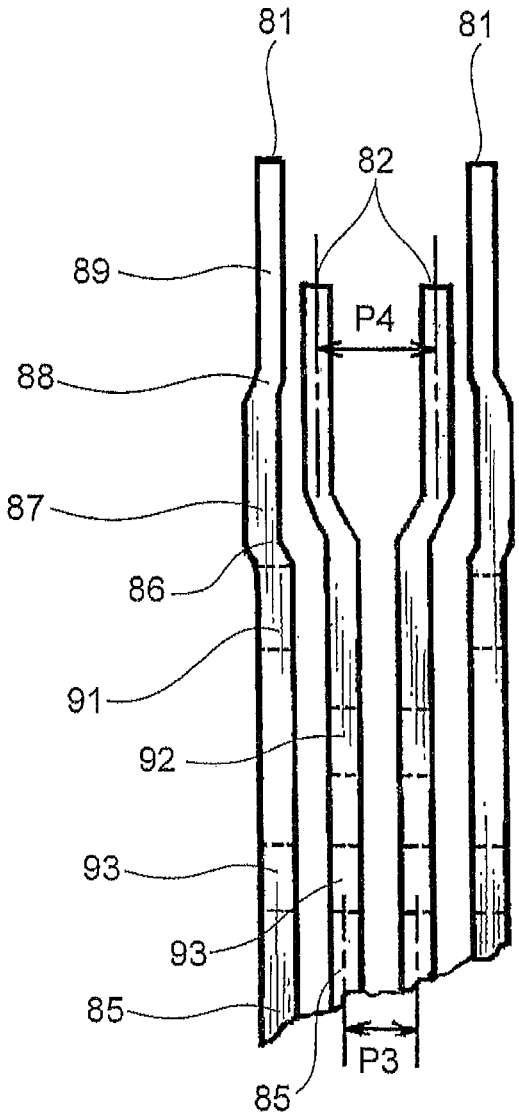
FIG. 30 is an enlarged view of a main portion of FIG. 29.

Referring to FIGS. 29 and 30, a lead frame 80' is shown as another example of an intermediate member for use in the manufacture of the above-mentioned contact group. The same reference symbols are assigned to the same or similar portions as those in FIGS. 27 and 28, thereby omitting explanation thereof.

In this lead frame 80', a first bending intended portion 91 is provided in a first straight portion 85. Specifically, the first bending intended portion 91 is provided at a position between a first offset portion 86 and a connecting portion 84 and adjacent to the first offset portion 86. As a result of changing the position of the first bending intended portion 91, the positions of a second bending intended portion 92 and additional bending intended portions 93 are located slightly closer to the connecting portion 84, but the essential function is the same as that of the lead frame 80 shown in FIG. 27.

In this lead frame 80', the distance from the first bending intended portion 91 to the free end, i.e. the length of the terminal portion 72*a* in FIG. 26, is slightly longer as compared with the lead frame 80 of FIG. 27, while, the others are the same in function and effect as those of the lead frame 80 of FIG. 27.

Figure 24:
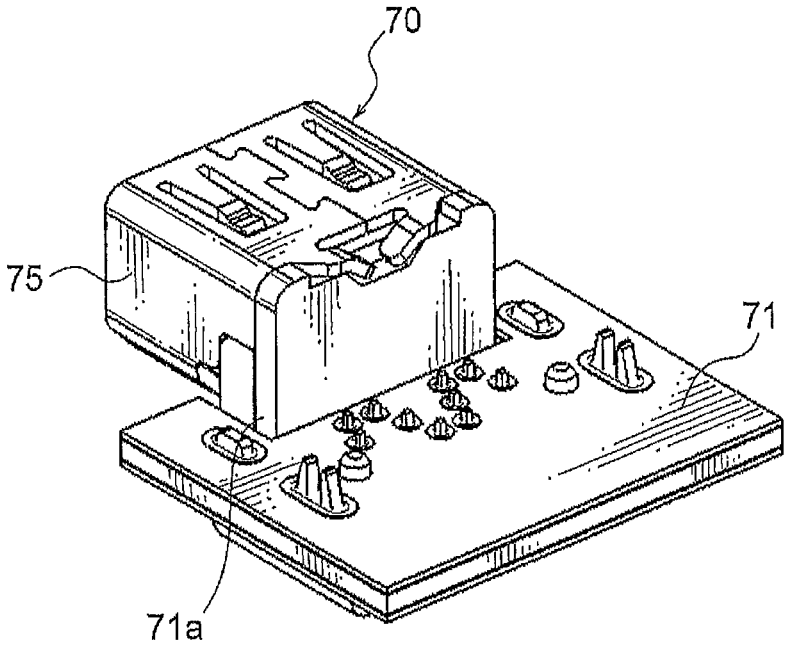
FIG. 24 is a perspective view showing a state where a differential signal connector according to a second embodiment of this invention is mounted on a board.
Figure 25:
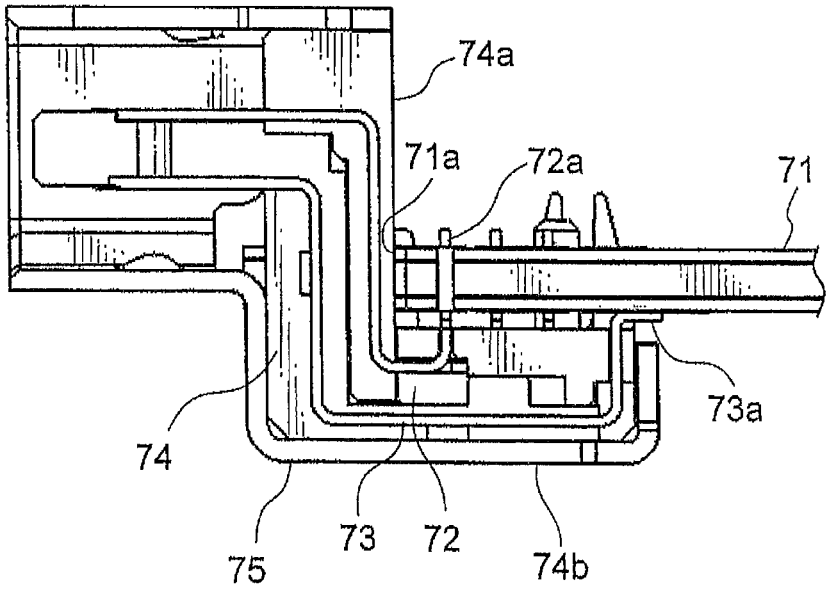
FIG. 25 is an enlarged cross-sectional view of a main portion of FIG. 24.

In the case of a connector of the type adapted to be disposed in substantially the same plane as a printed board as shown in FIGS. 24 and 25, each lead is provided with two additional bending intended portions 93 in either of the lead frames 80 and 80'. On the other hand, the lead frames 80 and 80' can each also be used for a connector of the type adapted to be mounted on an upper surface of a printed board as shown in FIGS. 4A to 4D while, in this case, the additional bending intended portion 93 is not required.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector for connecting a connection partner with a board, the connector comprising a plurality of contact pairs, a plurality of ground contacts, a plurality of additional contacts other than the contacts of the contact pairs and the ground contacts, and an insulating housing holding the contact pairs, the ground contacts, and the additional contacts, wherein the connector has a first connection side for connection to the connection partner and a second connection side for connection to the board, wherein, on the first connection side, the ground contacts and contacts of the contact pairs are arranged in one row to form a contact array and the ground contacts are arranged between the contact pairs, respectively, wherein, on the second connection side, the ground contacts are arranged in a first row so as to be spaced apart from each other in a first direction, while two of the contact pairs, which are arranged on both sides of each of the ground contacts on the first connection side, are arranged in a second row and a third row, respectively, which are located on both sides of the first row in a second direction perpendicular to the first direction, the contacts of the contact pairs being displaced from the ground contacts in the first direction, and wherein the additional contacts comprise a plurality of connecting portions, a plurality of holding portions, a plurality of intermediate portions and a plurality of bent portions, wherein each connecting portion of the plurality of connecting portions is located on the second connection side, each holding portion the plurality of holding portions is respectively located on the first connection side and away from the connecting portion, each bent portion of the plurality of bent portions is respectively bent between the holding portion and the connecting portion, and each intermediate portion of the plurality of intermediate portions respectively extends between the connecting portion and the bent portion, and wherein the insulating housing comprises a fitting projection holding the holding portions by insert molding, a locator positioned on the second connection side for holding the insulating housing, and a dielectric covering the intermediate portions without a gap between the dielectric and the intermediate portions and coupled to the locator by engaging projections.

2. The connector according to claim 1, wherein the locator has a recess and the dielectric is integrally formed with the intermediate portions by insert molding and is fitted in the recess.

3. The connector according to claim 1, wherein the holding member is mechanically coupled to the locator by means of boss fitting.

4. The connector according to claim 1, further comprising a shell covering the holding member and most of the locator, wherein the locator is partially projected from the shell.

* * * * *